US006734640B2

(12) United States Patent
Ribarich et al.

(10) Patent No.: US 6,734,640 B2
(45) Date of Patent: May 11, 2004

(54) SYSTEM AND METHOD FOR ELECTRONIC BALLAST DESIGN

(75) Inventors: Thomas J. Ribarich, Laguna Beach, CA (US); Peter Green, Redondo Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 10/193,955

(22) Filed: Jul. 11, 2002

(65) Prior Publication Data

US 2004/0007994 A1 Jan. 15, 2004

(51) Int. Cl.[7] ..... G05F 1/00; H05B 41/36
(52) U.S. Cl. ..... 315/291; 315/307
(58) Field of Search ..... 315/291, 307, 315/209 R, 308, 244, 224, DIG. 5, DIG. 7, DIG. 4, 200 R

(56) References Cited

U.S. PATENT DOCUMENTS 5,471,119 A * 11/1995 Ranganath et al. ..... 315/307
6,040,661 A * 3/2000 Bogdan ..... 315/224
6,150,773 A * 11/2000 Ribarich et al. ..... 315/291

* cited by examiner

*Primary Examiner*—Haissa Philogene
*Assistant Examiner*—Chuc Tran
(74) *Attorney, Agent, or Firm*—Ostrolenk, Faber, Gerb & Soffen, LLP

(57) ABSTRACT

A computer system and method to assist engineers in the design of dimming or non-dimming electronic ballasts for lamps based around lighting control ICs. The system and method reduces the design time dramatically by performing the complex iterative procedure required to optimize the operating points and component values of the circuit. The system and method produces a schematic, a bill of materials (listing all component values) and winding specifications for the inductors. The system contains a database of operating parameters for different types of lamps with the ability to add new lamps. The system also supports different configurations for one or two lamp ballast configurations.

36 Claims, 19 Drawing Sheets

IR2156 Bill of Materials (57 items)

File

Print Save BOM

| Qty | Type | Value | Rating | Tolerance | Reference |
|---|---|---|---|---|---|
| 1 | Bridge Rectifier | 1A | 1000V | | BR1 |
| 1 | X2 Capacitor | 0.1uF | 275VAC | | C1 |
| 2 | Capacitor | 0.1uF | 400V | | C2,CDC |
| 2 | Capacitor | 0.01uF | 25V | | C3,CVDC |
| 1 | Capacitor | 0.68uF | 25V | | C4 |
| 1 | Capacitor | 0.47uF | 25V | | C5 |
| 1 | DC Bus Capacitor | 10uF | 450V | | CBUS |
| 1 | Capacitor | 0.39uF | 25V | | CCPH |
| 1 | Capacitor | 100pF | 25V | | CCS |
| 1 | Resonant Capacitor | 6.8nF | 1500V | 5% | CRES |
| 1 | Snubber Capacitor | 1.5nF | 630V | | CSNUB |
| 1 | Capacitor | 820.0pF | 25V | 1% | CT |
| 3 | Capacitor | 0.1uF | 25V | | CVCC1,CBOOT,CSD |
| 1 | Capacitor | 2.2uF | 25V | | CVCC2 |
| 1 | Y Capacitor | 2.2nF | 250VAC | | CY |
| 1 | Diode | 1N4148 | | | D1 |
| 1 | Bootstrap Diode | 600V | 1A | | DBOOT |
| 1 | Charge Pump Zener | 17V | 500mW | | DCP1 |
| 1 | Charge Pump Diode | 1N4148 | | | DCP2 |
| 1 | PFC Diode | 600V | 1A | | DPFC |
| 1 | Fuse | 2A | 250VAC | | F1 |
| 1 | Ballast Control IC | IR2156 | | | IC BALLAST |
| 1 | PFC IC | L6561 | | | IC PFC |
| 1 | EMI Inductor | 2x10mH | 0.1A | | L1 |
| 1 | Current Transformer | 2x10mH | | | LHEAT |
| 1 | PFC Inductor | 2.8mH | 0.35Apk | 5% | LPFC:A |
| 1 | Secondary Winding | 10 Turns | | | LPFC:B |
| 1 | Resonant Inductor | 5.6mH | 1.14Apk | 5% | LRES |
| 2 | Half-Bridge MOSFET | IRF820 | | | MHS,MLS |

64

Figure 11

SYSTEM AND METHOD FOR ELECTRONIC BALLAST DESIGN

FIELD OF THE INVENTION

The present invention refers generally to designing components and circuits using a computer, and more particularly, is directed to a computer application for designing electronic ballasts that, among other things, outputs circuit diagrams, bills of materials, and inductor specifications for manufacturing electronic ballast circuits.

BACKGROUND OF THE INVENTION

Computer applications for designing high frequency electronic ballasts are currently available. For example, U.S. Pat. No. 6,150,773 discloses a method for designing the output stage of an electronic ballast using computer software, the entire contents of which are incorporated herein by reference. As disclosed therein, a user first specifies a plurality of parameters relating to the operation of a fluorescent lamp, including running power, running voltage and maximum pre-heating voltage for the lamp. The user also selects a minimum running frequency for the lamp and selects an input voltage for the ballast. The system thereafter calculates the value for the inductor of the output stage, and also calculates the pre-heat frequency, the ignition frequency, the running frequency, the pre-heat voltage, and the ignition current. Furthermore, the program calculates a value for the capacitor of the output stage such that the pre-heat frequency is greater than the ignition frequency, the ignition frequency is greater than or equal to the running frequency, the pre-heat voltage is less than the maximum pre-heat voltage, and the difference between the pre-heat frequency and the ignition frequency is greater than about 5 kHz.

SUMMARY OF THE INVENTION

The present invention simplifies the process of designing a ballast and outputs specifications directed to one or more inductors needed for the ballast circuit. The invention further receives specifications directed to a selected one of a plurality of ballast control integrated circuits (ICs). The invention develops a circuit diagram and bill of materials for the ballast using the selected control IC.

In order to provide such a ballast design system, the invention comprises a system operating on a digital computer that includes a plurality of modules. These modules include: a line input module receiving a line input voltage for the ballast; a lamp input module receiving a type of lamp for the ballast; a control IC module receiving a ballast integrated circuit chip for the ballast; and a lamp configuration module receiving a configuration for one or more lamps for the ballast.

BRIEF DESCRIPTION OF THE DRAWING(S)

For the purposes of illustrating the invention, there is shown in the drawings a form which is presently preferred, it being understood, however, that the invention is not limited to the precise arrangements and instrumentality shown. The features and advantages of the present invention will become apparent from the following description of the invention that refers to the accompanying drawings, in which.

Figure 7:
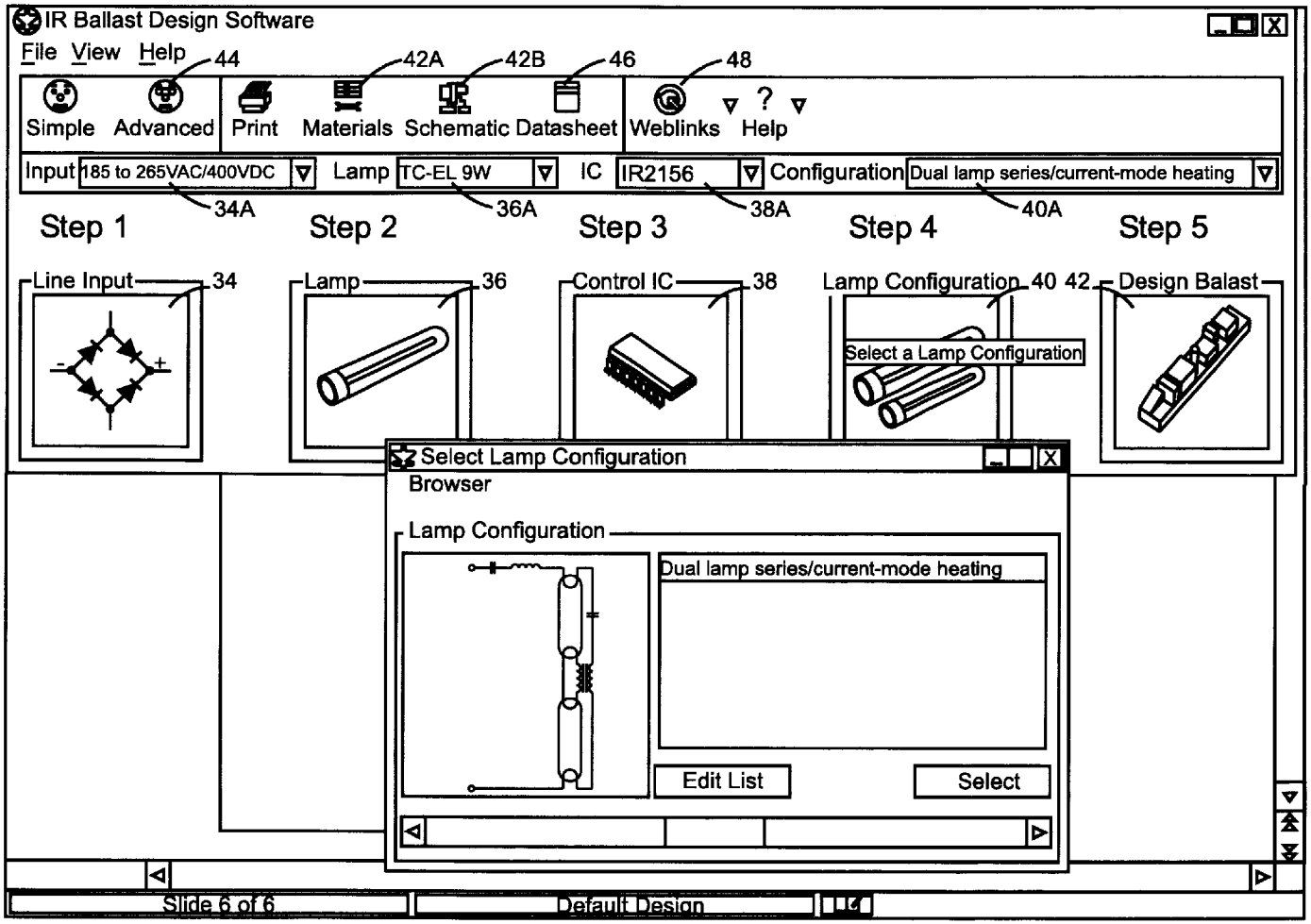
FIG. 7 illustrates selection of a lamp configuration in accordance with the principles of the present invention.
Figure 7A:
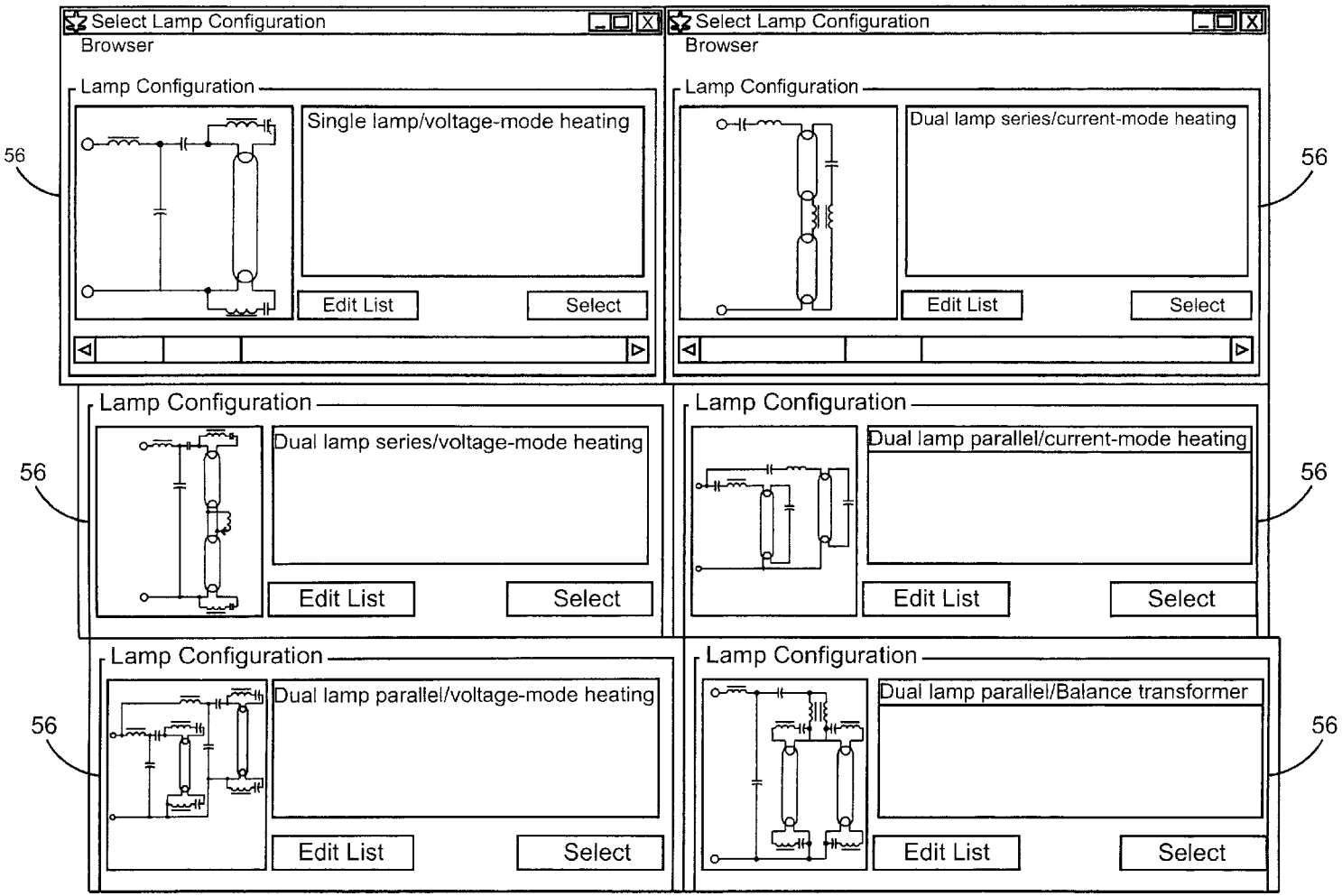
Figure 8:
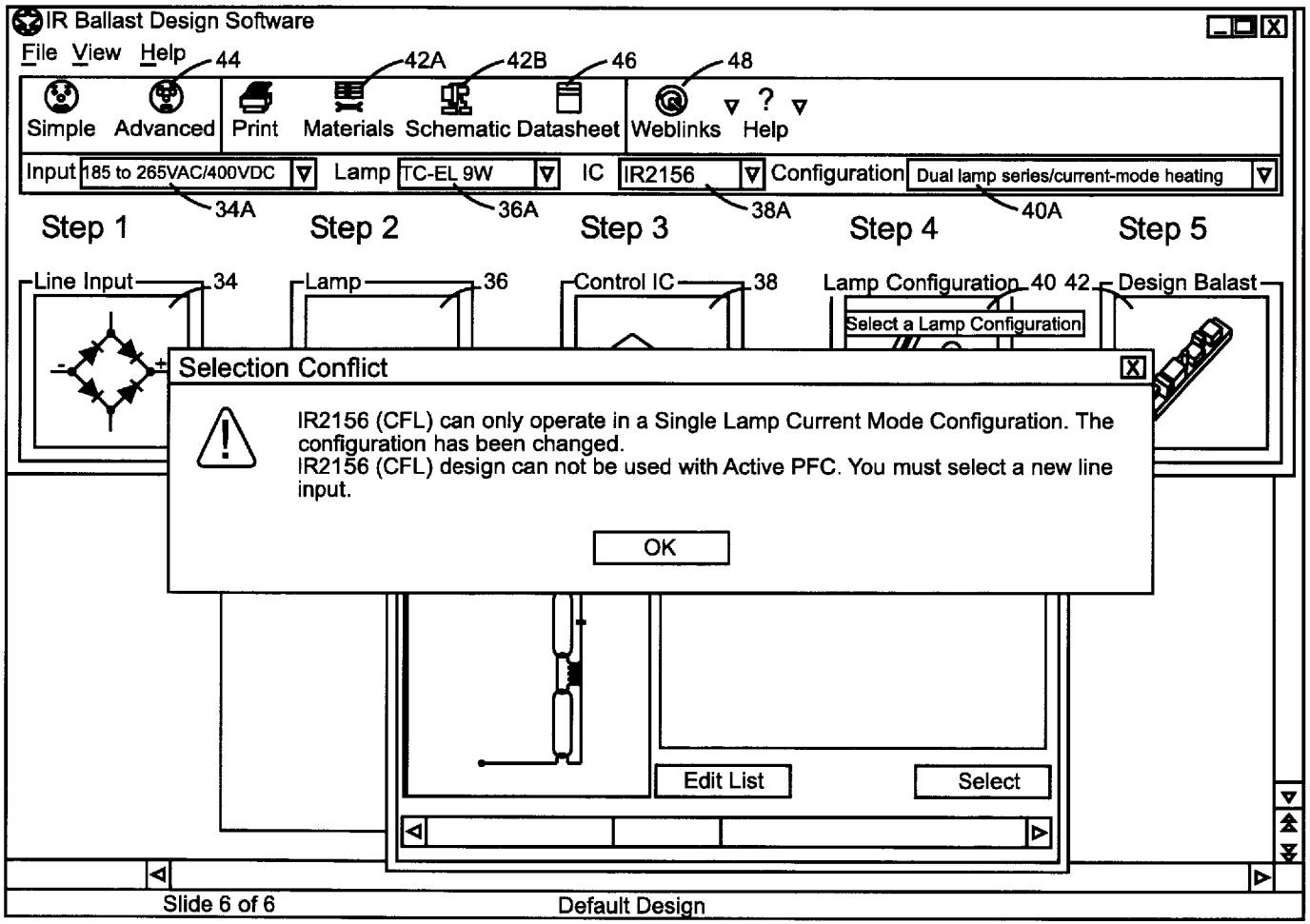
Figure 9:
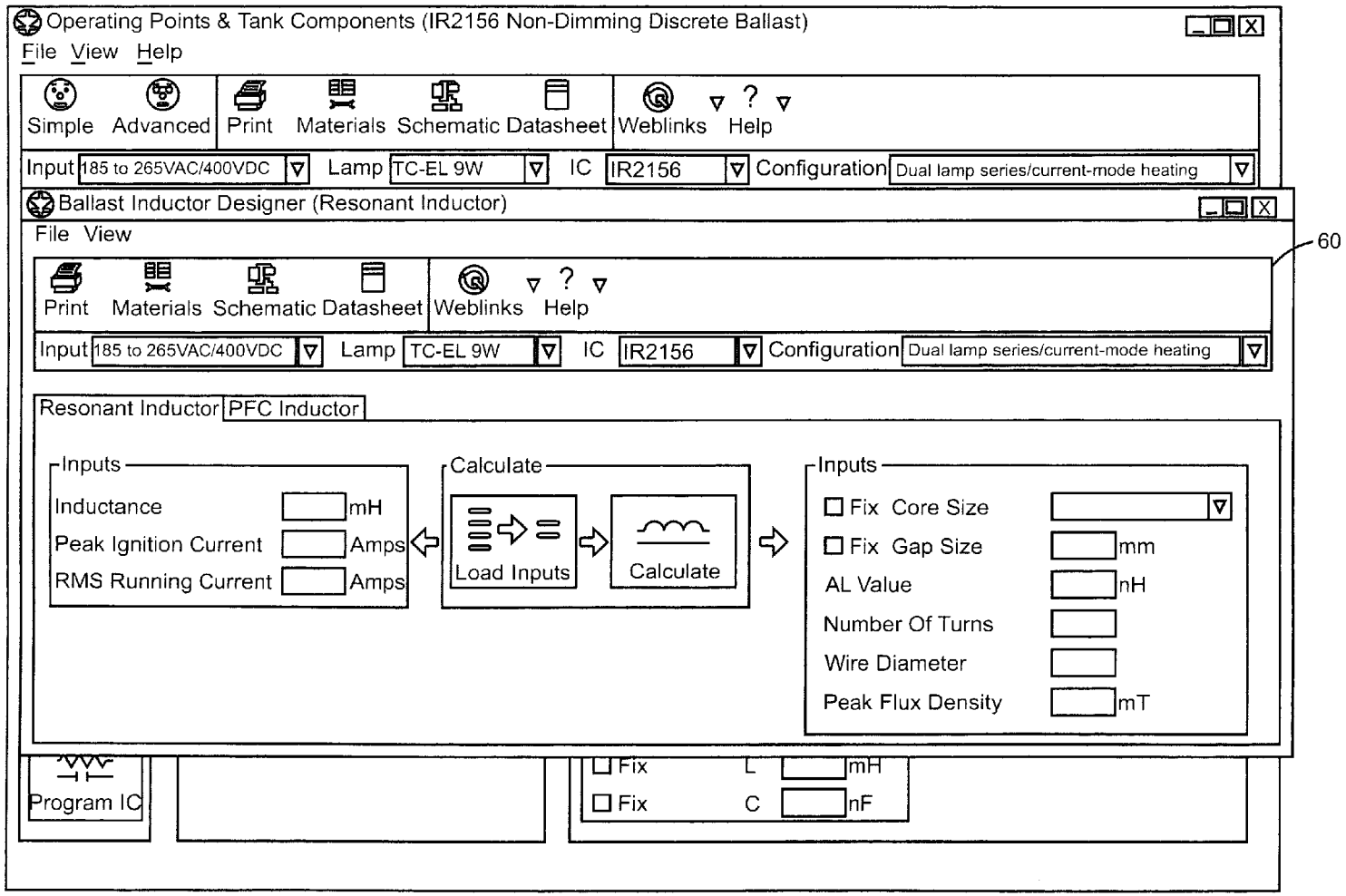
Figure 10:
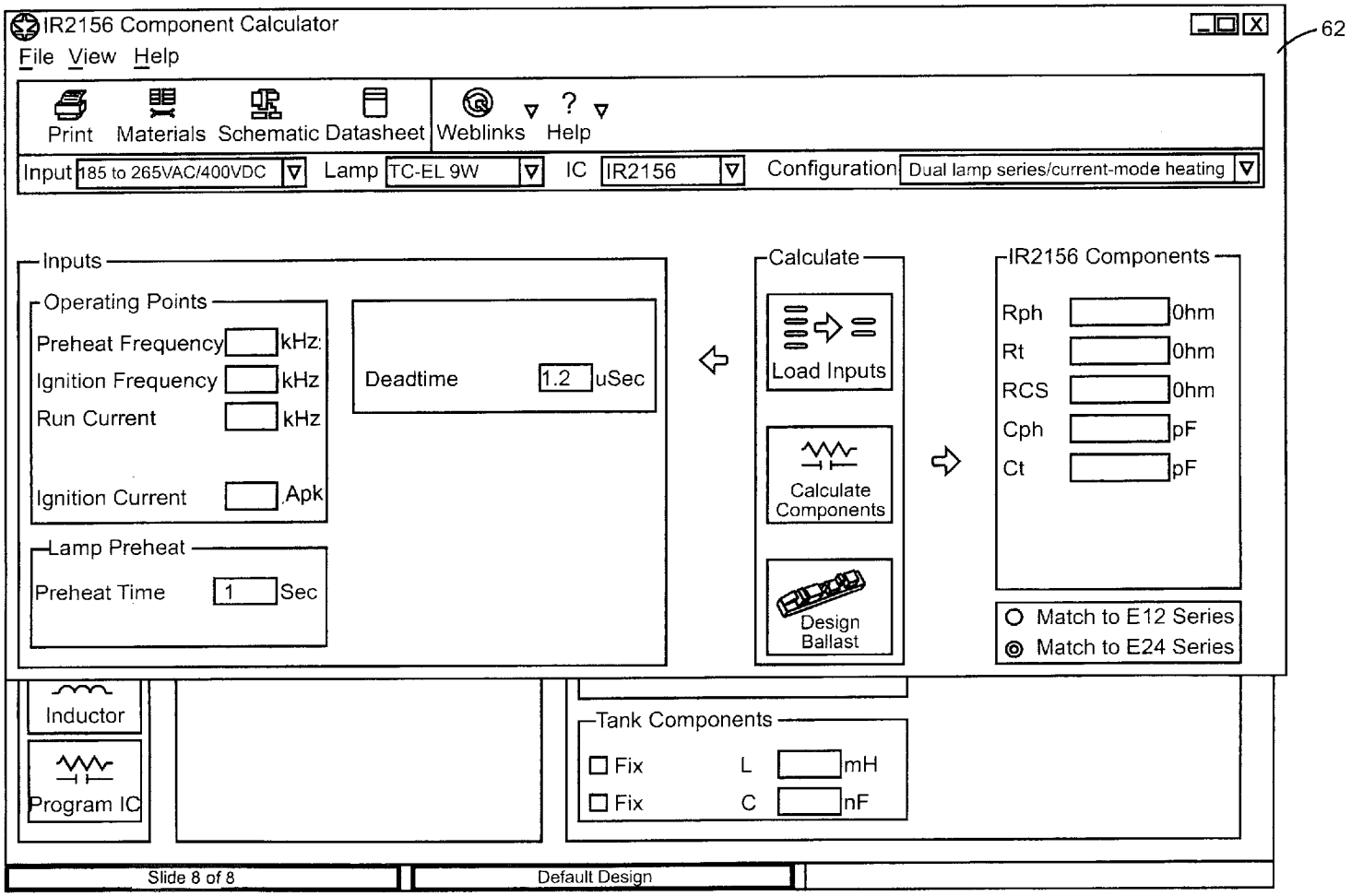
Figure 12:
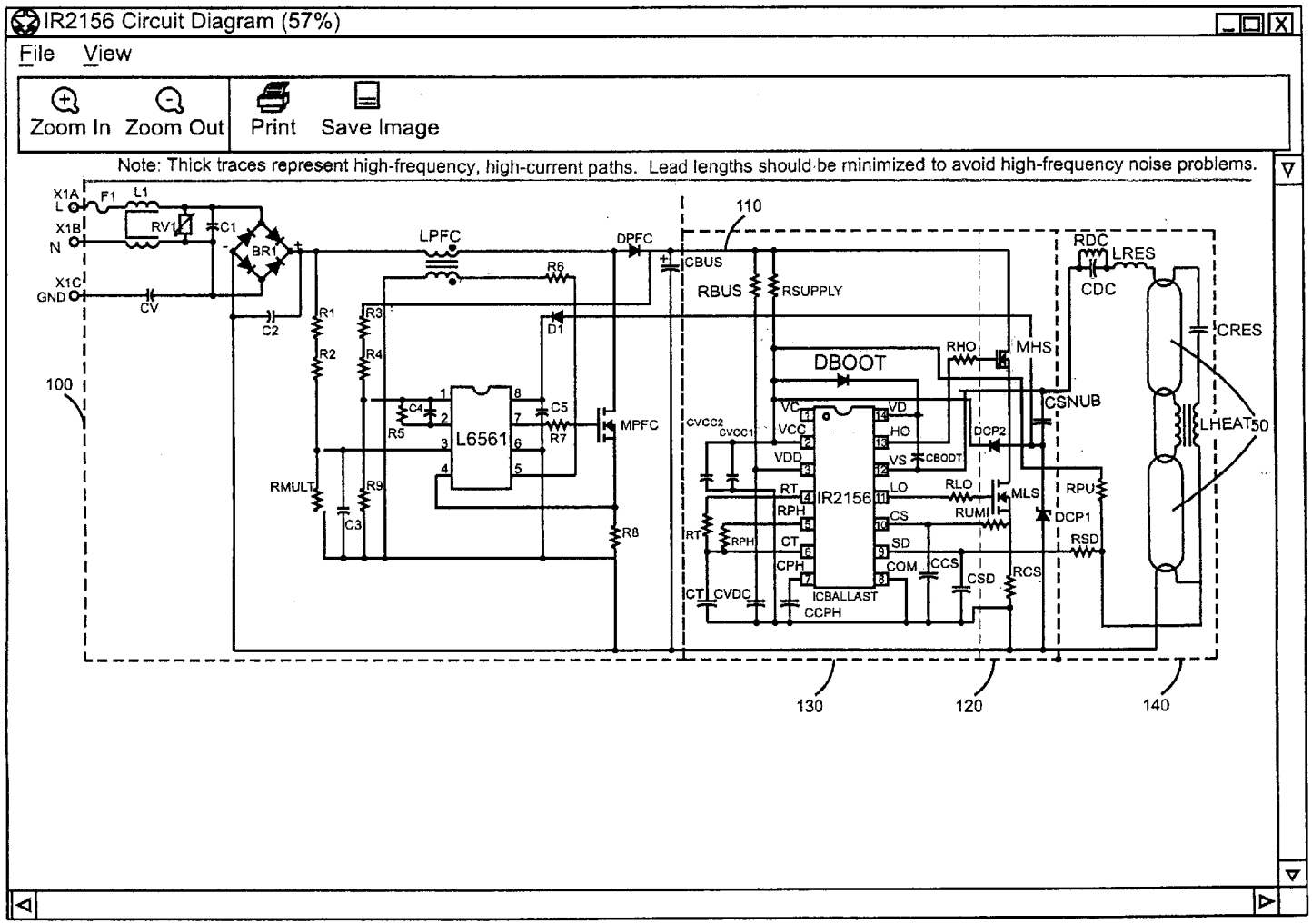
Figure 14:
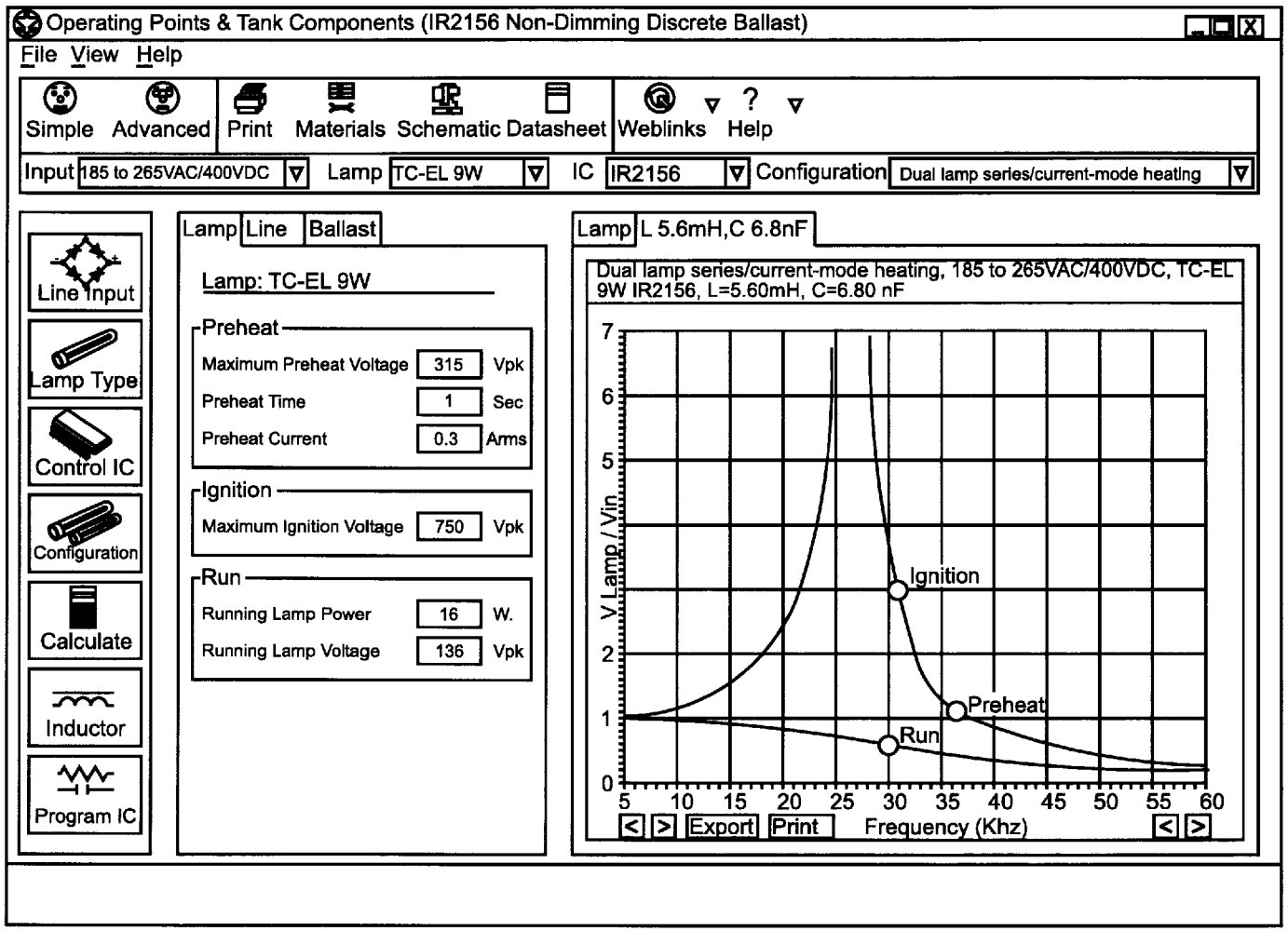
Figure 15:
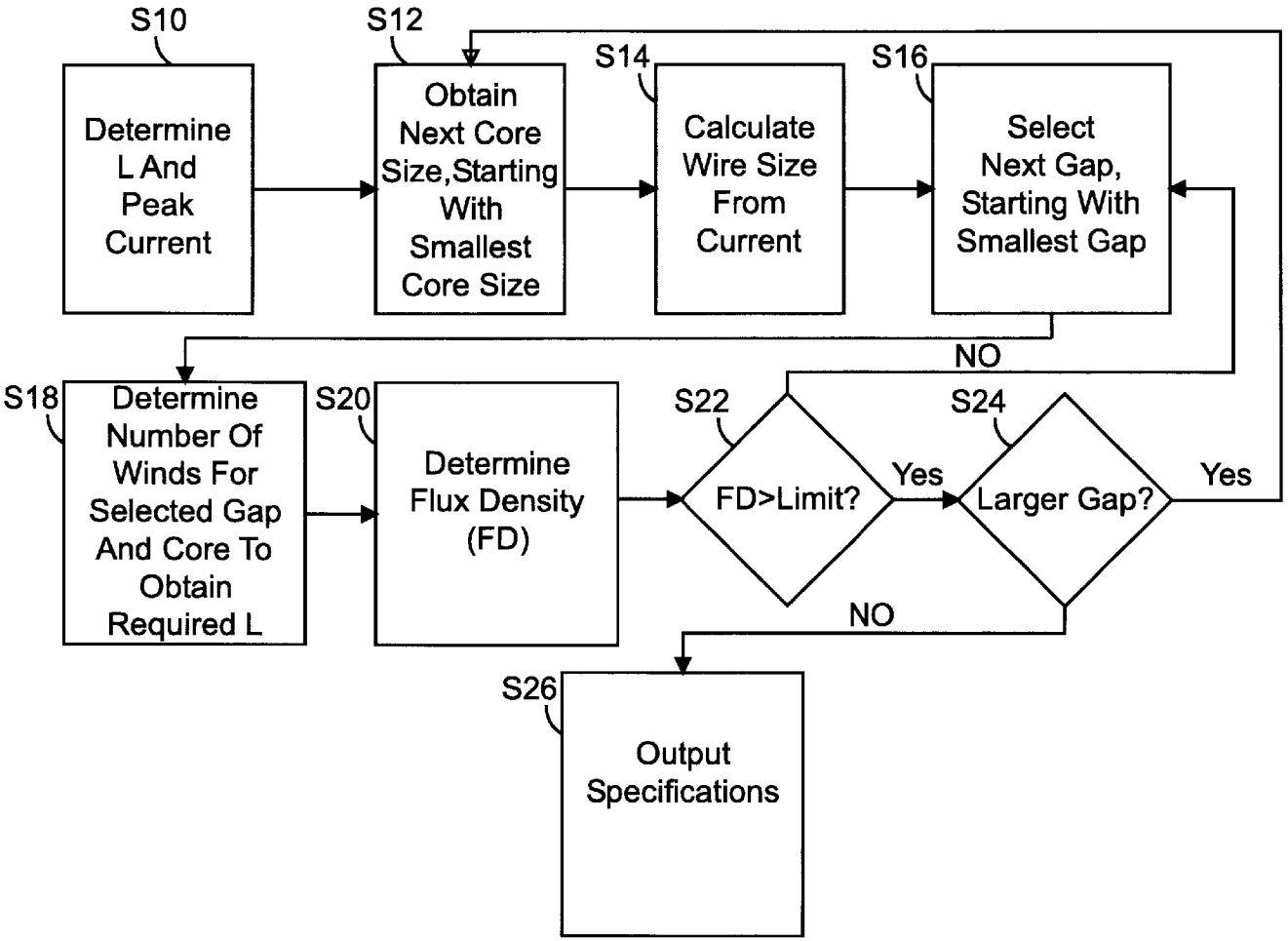

FIG. 7A identifies six additional lamp configurations that are available via the present invention;

FIG. 8 shows an example display screen that appears in the event of a conflict or other incompatibility during the selection process, in accordance with the principles of the present invention;

FIG. 9 illustrates advanced options for designing an inductor in accordance with the principles of the present invention;

FIG. 10 identifies advanced options for programming line inputs in accordance with the principles of the present invention;

FIG. 11 identifies an illustrative bill of materials that is generated in accordance with the principles of the present invention;

FIG. 12 illustrates an illustrative circuit diagram for a ballast circuit in accordance with the principles of the present invention;

FIGS. 13(*a*) and 13(*b*) identify inductor specifications generated in accordance with the principles of the present invention;

FIG. 14 shows an advanced options display screen including a graph identifying the operating points that are calculated in accordance with the principles of the present invention; and FIG. 15 is a flowchart identifying the processes associated with designing an electronic ballast circuit in accordance with the principles of the present invention.

DETAILED DESCRIPTION OF EMBODIMENTS OF THE INVENTION

Figure 1:
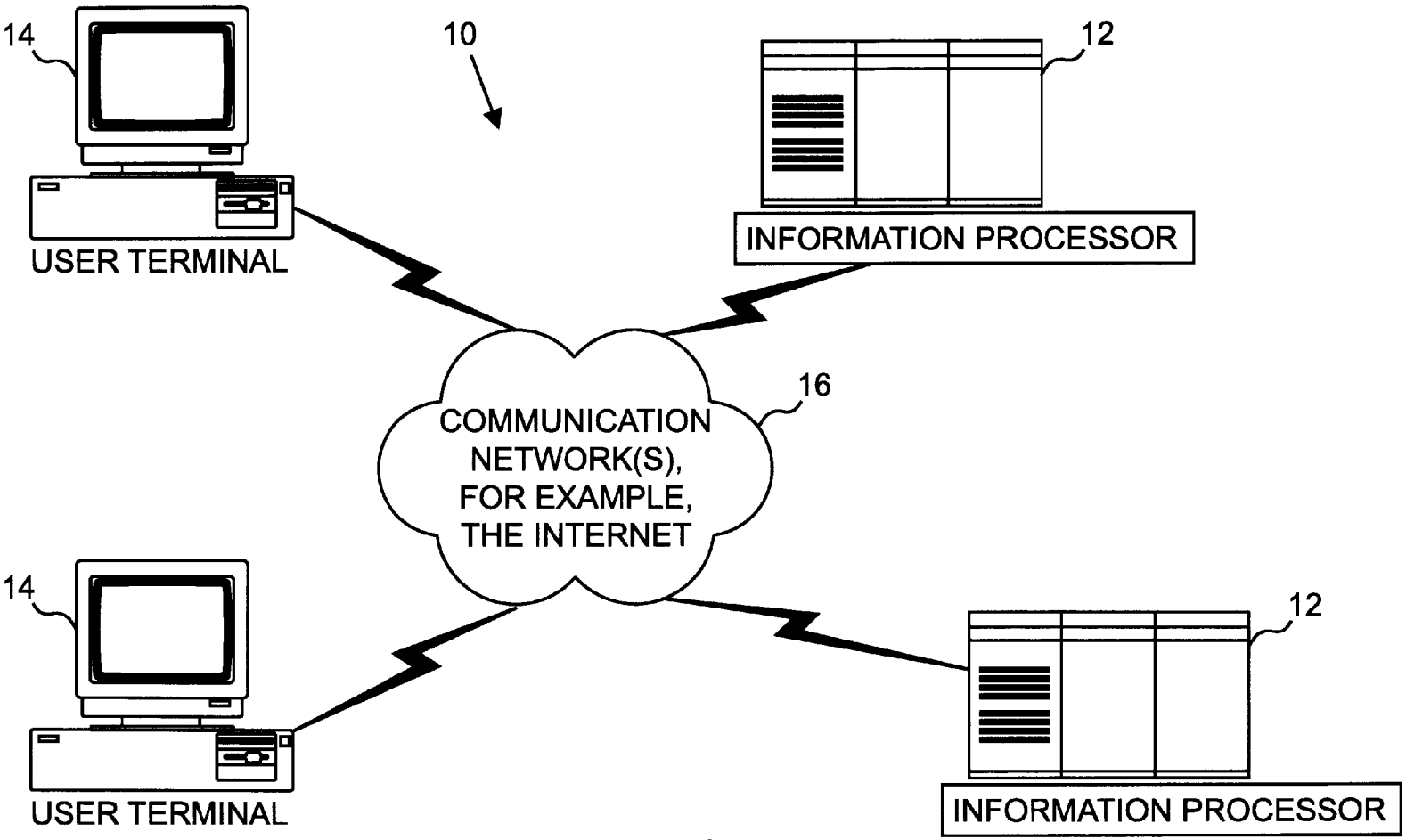
FIG. 1 illustrates a hardware arrangement for a preferred embodiment of the invention.

Referring now to the drawing figures, in which like reference designators refer to like elements, there is shown in FIG. 1 an example of a hardware arrangement in a preferred embodiment of the present invention for designing a circuit and generally referred to as the ballast designing system 10.

The ballast designing system 10 provides a unique and simplified way to design an electronic ballast circuit. In accordance with the principles of the present invention, a user provides the following criteria:

1. Line Input Voltage (US 80V–140V or Europe 185V–265V power factor corrected or non-power factor corrected);
2. Lamp Type (database of 36 lamps with the ability for the user to add additional lamp types);
3. Control I.C. (supports a plurality of control ICs, e.g., the IR2156, the IR21571 and the IR2159); and
4. The output configuration (one or two lamps, dual lamp series or parallel arrangement, voltage or current mode cathode heating).

After the user submits these four criteria, the present invention functions to produce a schematic, a bill of materials listing all component values, and specifications for inductors (including winding specifications).

The design process involves lengthy and complex calculations that need to take into account many different operating parameters. The process is iterative and requires that calculations be carried out several times in order to converge and provide acceptable operating points. The ballast designing system 10 completes the calculations almost instantaneously, thus saving the ballast designer many hours of tedious calculation and possible error.

The present invention preferably produces detailed specifications that contain all the information required in order to manufacture ballasts designed by the present invention including inductors. The present invention further includes a module to generate specifications for a resonant output inductor as well as a power factor correction circuit inductor, if used. This process is also iterative. The present invention preferably takes into account the very high inductor current that occurs during lamp ignition. This avoids the possibility of a ballast shutting down due to saturation of the output inductor at lamp ignition.

Figure 2:
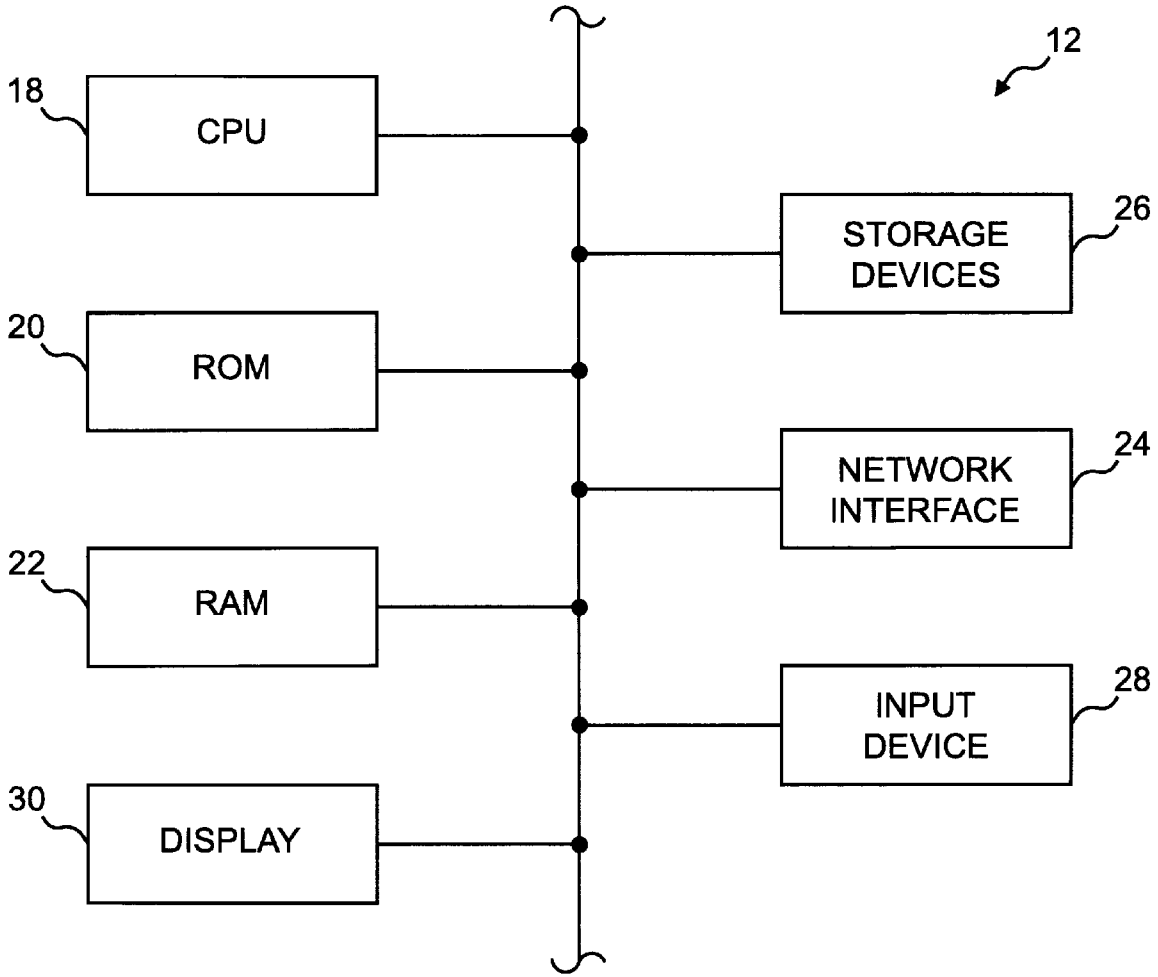
FIG. 2 is a block diagram of the functional elements constructed in accordance with the present invention.

As shown in FIGS. 1 and 2, the functional elements of each information processor 12 include one or more central processing units (CPU) 18 used to execute software code and control the operation of information processor 12, read-only memory (ROM) 20, random access memory (RAM) 22, one or more network interfaces 24 to transmit and receive data to and from other computing devices across a communication network, storage devices 26 such as a hard disk drive, floppy disk drive, tape drive, CD ROM or DVD or storing program code, databases and application data, one or more input devices 28 such as a keyboard, mouse, track ball, microphone and the like, and a display 30.

The various components of information processor 12 need not be physically contained within the same chassis or even located in a single location. For example, storage device 26 may be located at a site which is remote from the remaining elements of information processors 12, and may even be connected to CPU 18 across communication network 16 via network interface 24. Information processors 12 include a storage device 26 equipped with sufficient storage to provide necessary databases as well as acting as a web server for communicating hypertext markup language (HTML), Java applets, Active-X control programs and the like to user terminals 14. Information processors 12 are arranged with components, for example, those shown in FIG. 2, suitable for the expected operating environment of information processor 12. The central processing unit(s) 18, network interface(s) 24 and memory 20, 22 and storage devices 26 are selected to ensure that capacities are arranged to accommodate expected demand.

The functional elements shown in FIG. 2 (designated by reference numerals 18–30) are of the same categories of functional elements present in user terminals 14. However, not all elements need be present, for example, storage devices in the case of PDAs and the capacities of the various elements are arranged to accommodate the expected user demand. For example, CPU 18 in user terminal 14 may be a smaller capacity CPU than the CPU present in the information processor 12. Similarly, it is likely that the information processor 12 will include storage devices of a much higher capacity than storage devices present in user terminal 14.

Of course, one of ordinary skill in the art will understand that the capabilities of the functional elements can be adjusted as needed. The nature of the invention is such that one skilled in the art of writing computer executable code (software) can implement the described functions using one or more or a combination of a popular computer programming languages including, but not limited to C++, Visual Basic, Java, Active-X, HTML and web application development environments.

It is contemplated that the ballast designing system 10 can be arranged such that user terminals 14 can communicate with and display data received from information processors 12 using any known communication and display method, for example, using a non-Internet browser WINDOWS viewer coupled with a local area network protocol such as the Internet Packet Exchange (IPX), dial-up, third-party, private network or a value added network (VAN).

It is further contemplated that any suitable operating system can be used on user terminal 14, for example, MS-DOS, Windows 3.x, Windows 95, Windows 98, Windows NT, Windows 2000, Windows XP, Windows ME, Windows CE, Mac OS, Unix, Linux, Palm OS and any suitable PDA operating system.

Figure 2A:
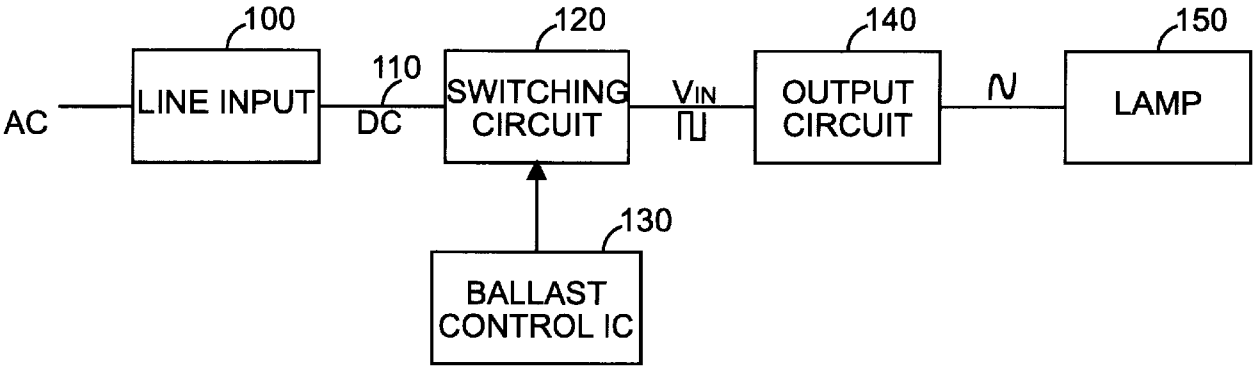
FIG. 2A is a block diagram of an electronic ballast, including an AC line input, a switching circuit, a ballast control IC, an output circuit, and a lamp.

FIG. 2A shows the basic block diagram of an electronic ballast. Typically, an electronic ballast includes an AC line input 100, which provides a DC voltage 110, a switching circuit 120, for producing a high frequency square wave voltage $V_{IN}$ that is controlled by a ballast control circuit 130. The output $V_{IN}$ of the switching circuit is provided to an output circuit 140, which is typically an LC resonant circuit. The circuit 140 supplies a sinusoidal high frequency voltage to lamp 150.

Figure 2B:
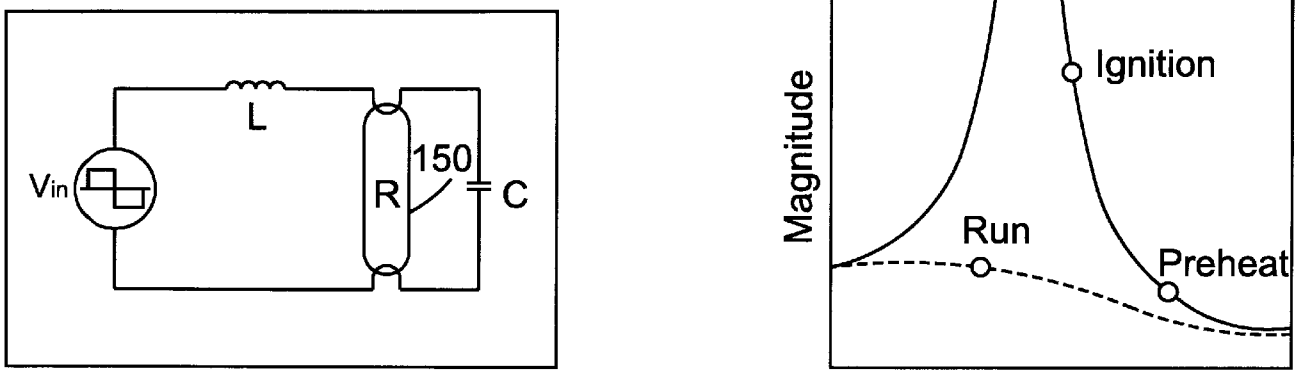
FIG. 2B shows a simplified model used to design the output stage of a ballast circuit in accordance with the principles of the present invention.

FIG. 2B shows a typical output circuit comprising an inductor L and capacitor C.

The line input circuit 100 may be a full bridge rectifier, half bridge rectifier, voltage doubler or PFC circuit, or some other line input circuit. If a PFC circuit is used, a PFC circuit inductor typically is employed.

Figure 2C:
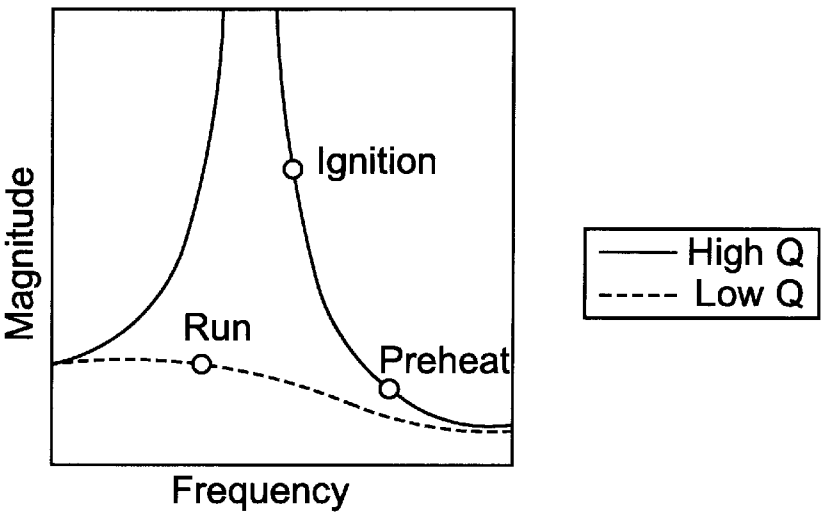
FIG. 2C shows a transfer function of an RCL circuit with typical operating points.

FIG. 2C shows a transfer function of RCL circuit with typical operating points.

The present invention enables the ballast designer to design each of the blocks shown in FIG. 2A, including alternatives on the various blocks, and provides a full schematic circuit diagram with an itemization of all components and component values, including manufacturing specifications for all inductors employed.

Figure 3:
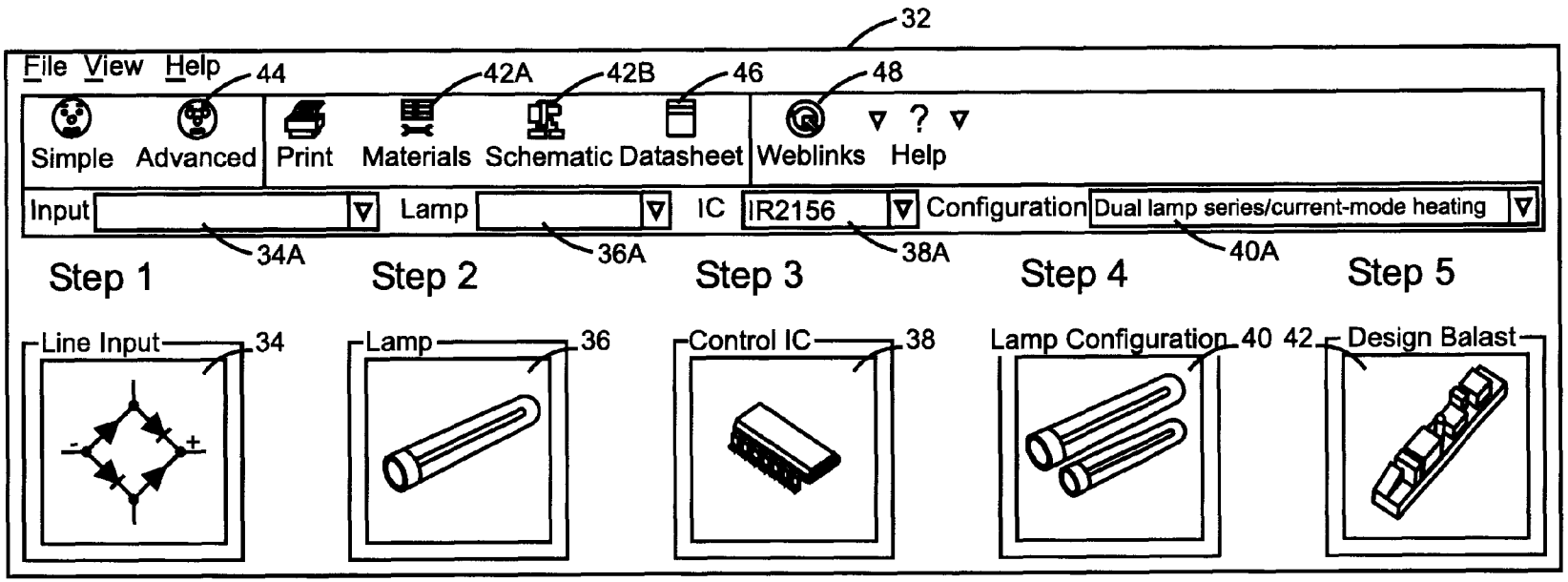
FIG. 3 shows a sample main menu display screen for designing an electronic ballast circuit in accordance with the principles of the present invention.

FIG. 3 shows a sample main menu display screen 32 that is displayed when a user begins operating the present invention. As shown in FIG. 3, a series of graphic controls are preferably available that enable the user to provide the requisite criteria to generate an electronic ballast circuit design. Moreover, graphic controls are available that enable a user to cause the ballast designing system 10 to generate a full schematic, bill of materials and inductor specifications for the finished electronic ballast circuit.

In a preferred embodiment of the present invention, the main menu display screen 32 provides for redundant mechanisms to perform many of the tasks described herein. For example, a user can specify a line input via two or more graphic controls. Line input button 34 and line input drop-down list 34A both enable a user to select from a plurality of input specifications in order to generate output for an electronic ballast circuit. As described in greater detail with respect to FIGS. 4–7, when a user selects one of the button controls (e.g., line input button 34, lamp button 36, control IC button 38 or lamp configuration button 40), the user is preferably presented with more descriptive information regarding the respective selected choice. Alternatively, if the user elects to select inputs via the drop-down lists (line input 34A, lamp input 36A, control IC input 38A and lamp configuration 40A) then only a brief description of each choice, for example, a model number or a name, is displayed. Therefore, when a user wants to see greater detail regarding available input choices, then the button controls are preferably selected.

In a preferred embodiment of the present invention, different modes of operation are available for users. For example, a simple mode and an advanced mode provide users with less or more control over the variables used to design an electronic ballast circuit. When the ballast designing system 10 operates in simple mode, the user does not see any parameters or calculated results. After the user selects the design ballast button 42 (FIG. 3), only a schematic with a bill of materials and specifications for the output inductor and, if required, power factor correction inductor are produced. This feature allows users to obtain the information needed to construct an electronic ballast circuit without being involved in, or needing to understand, the complex process of ballast circuit design.

The ballast designing system 10 also has advanced options that allow the designer to adjust the parameters or fix the values of the output inductor and capacitor. Having done this the invention preferably recalculates the operating points and component values required based around the adjusted values. The user preferably sees a graphical display showing the preheat, ignition and running frequencies (for dimming designs, the maximum and minimum frequencies are given) of the system to determine whether the values are acceptable. The calculated parameters can also be displayed and the user is able to adjust and then recalculate them should the user wish to experiment with possible values of L and C other than those provided. It is also possible to adjust the other operating parameters to find out what the effect would be if something were to be altered. In a preferred embodiment of the present invention, a user can select an advanced display icon to refine the values that are automatically entered by the system. More details regarding advanced options are found below with regard to FIGS. 9, 10 and 14.

After a user is satisfied with the selections for the criteria of the electronic ballast circuit, the user preferably selects a graphic control to cause the ballast designing system 10 to generate output directed to the ballast circuit. For example, the user selects the design ballast button 42 which invokes a series of modules to produce a bill of materials, generate a full schematic of the circuit, and to provide in depth or related specifications. Alternatively, a user can select the materials icon 42A and/or the schematic icon 42B to cause the ballast designing system 10 to produce output directed only to materials (42A) or a circuit schematic (42B). Moreover, data sheets icon 46, when selected, causes the ballast designing system 10 to retrieve and display information directed to the ballast IC that has been selected, for example, by use of the control IC button 38 or the control IC text box 38A. Also in a preferred embodiment, web links icon 48, when selected, enables a user to select from a plurality of, for example, hyper-links over a network connection, such as the Internet, to manufacturers and suppliers of the components listed on the bill of materials for on-line ordering or information purposes.

Figure 4:
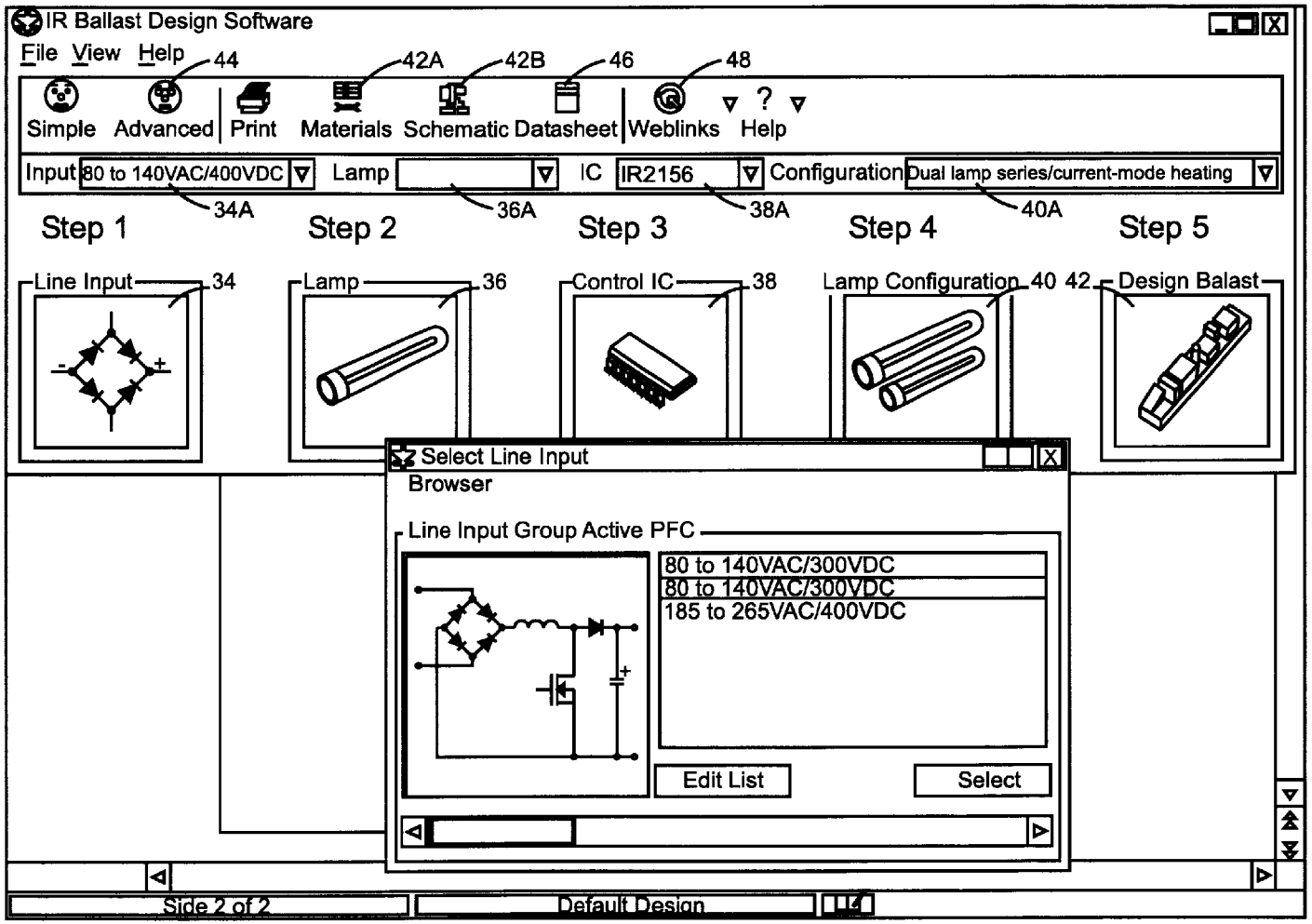
FIG. 4 shows selection of a line input in accordance with the principles of the present invention.
Figure 4A:
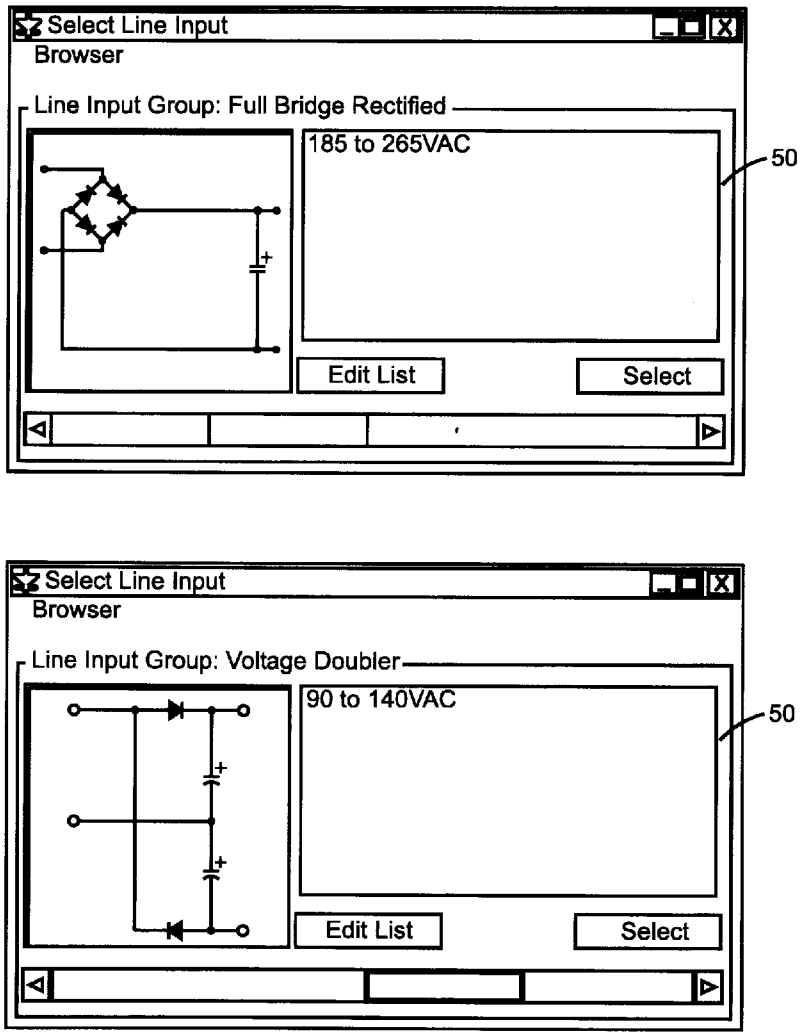
FIG. 4A illustrates two alternative line input selections offered in accordance with the principles of the present invention.

FIG. 4 shows a line input selection display screen 50 that is preferably presented to the user after the line input button 34 is selected. As shown in FIG. 4, the line selection display screen 50 identifies a line input group that comprises the line input choices therefor. In the example shown in FIG. 4, the line input group for active power factor correction ("PFC") is shown. Moreover, an image is included in the line selection display screen 50 that shows the current line input group. To view and select a different line input group, a user of the ballast designing system 10 preferably moves the slider control at the bottom of the line selection input display screen 50. Other input groups that are preferably available via the present invention are shown in FIG. 4A. Moreover, a custom user-specified line input group can be developed and used. Therein, the user identifies the preheat DC Bus (V), the ignition DC Bus (V), the run DC Bus (V), the PFC frequency, if any, the minimum line input (V), the maximum line input (V), the ballast run frequency, any maximum DC bus voltage, minimum DC bas voltage, whether PFC should be included, and specific line input, for example, an active boost PFC, full bridge rectifier, or voltage doubler. In this way, users can develop and define custom line inputs for designing a ballast.

FIG. 4A shows alternative line input groups that are available in accordance with the principles of the present invention. As shown in FIG. 4A, a full bridge rectifier and a voltage doubler are selectable.

Figure 5:
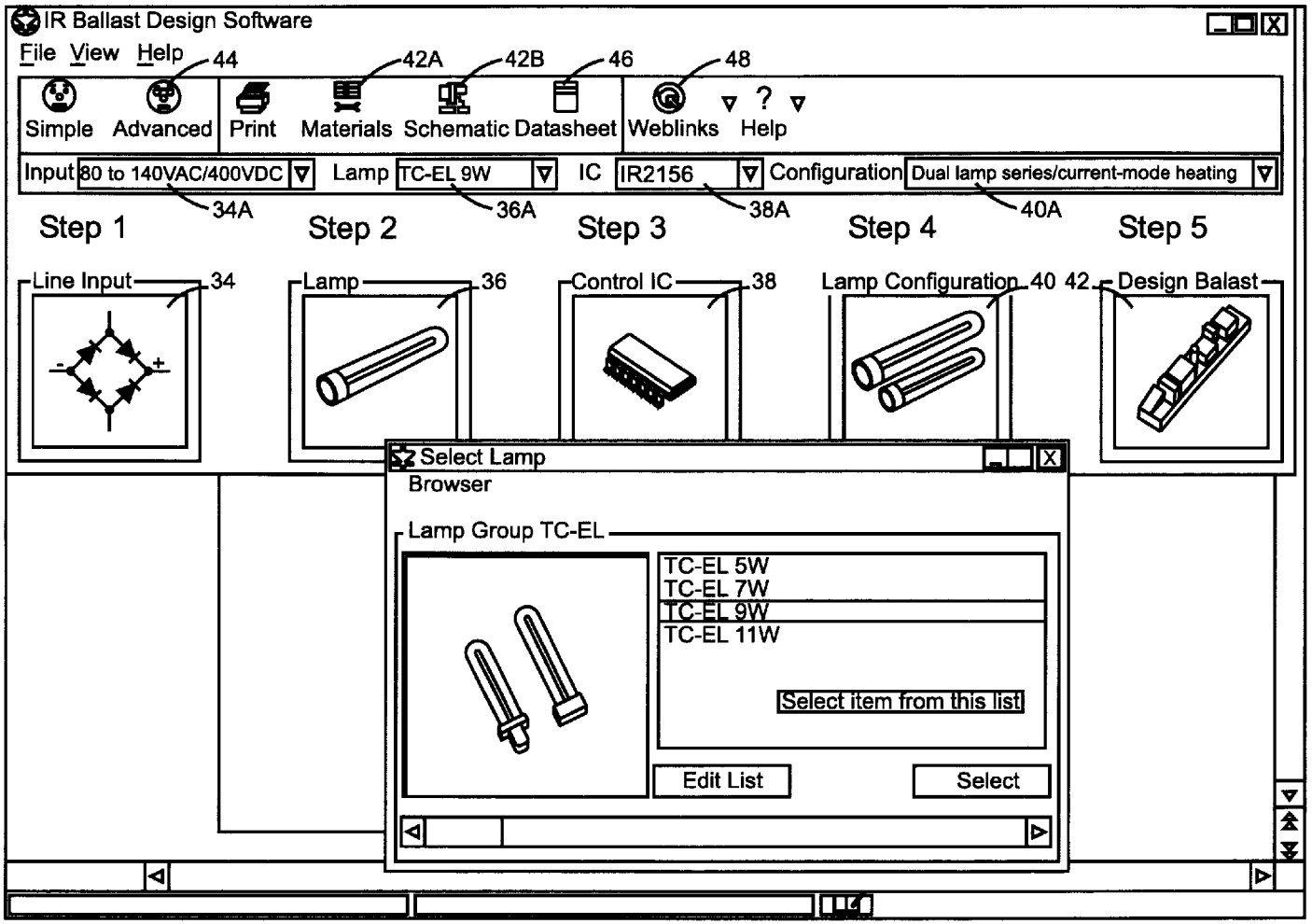
FIG. 5 shows selection of a lamp in accordance with the principles of the present invention.

FIG. 5 shows a sample lamp selection display screen 52 that is used to identify a particular lamp that will be used in the ballast circuit. Similar to that shown in FIG. 4, specifically in the line selection input display screen 50, a group is preferably available for lamp types and is selectable by moving a slider control at the bottom of the lamp selection display screen 52. Lamp groups that are preferably available via the present invention include TC-EL groups, TC-DEL groups, triple lamp groups, triple lamps, spiral lamps, PL-L lamps, T5 linear lamps, T8 linear lamps, T12 linear lamps, and one or more user-defined lamps. Within each lamp group, one or more specific lamp models are preferably available for the user to select to be included in the electronic ballast circuit. In the example shown in FIG. 5, the TC-EL 9 watt lamp is selected.

Figure 6:
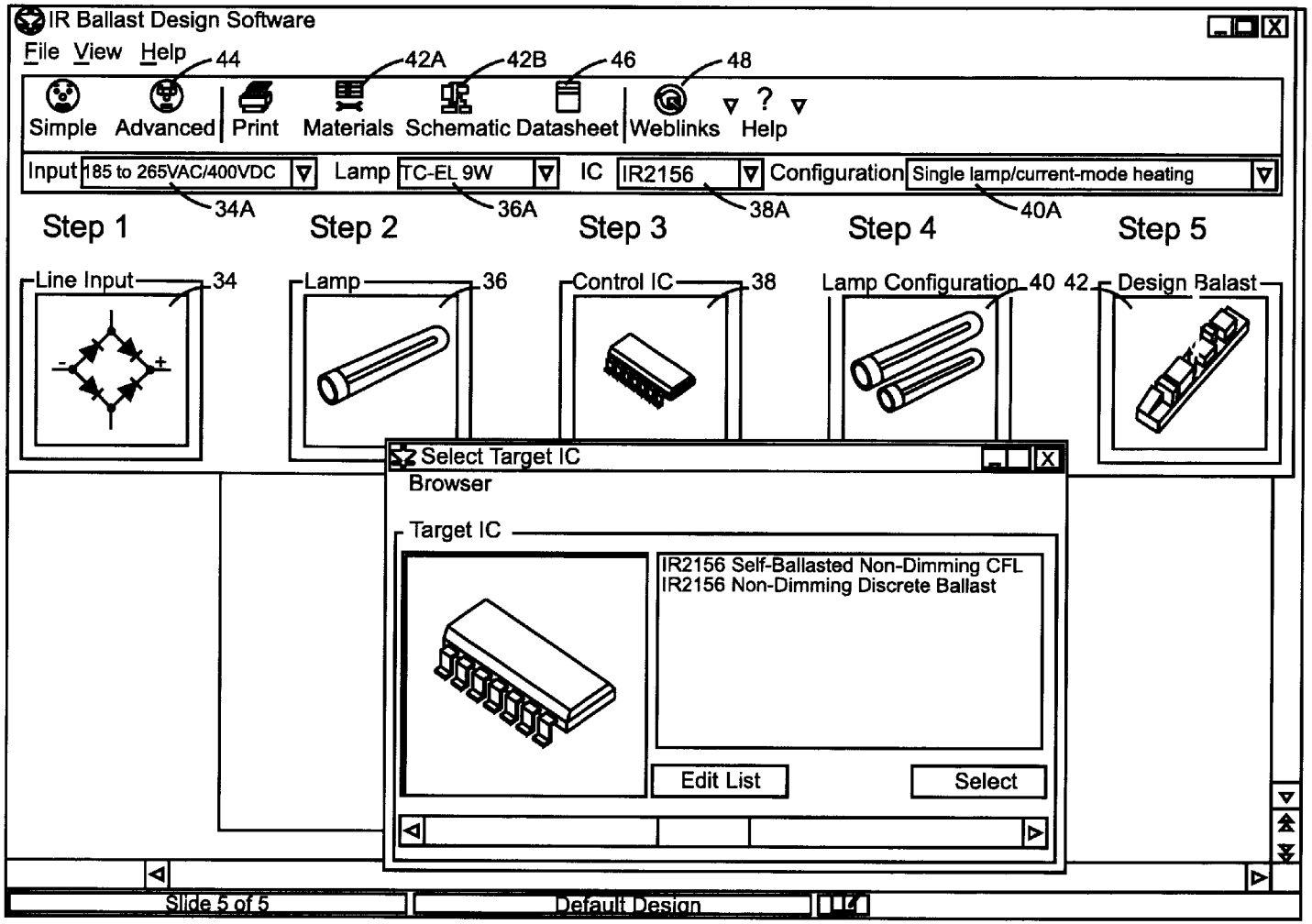
FIG. 6 depicts selection of a target IC in accordance with the principles of the present invention.

FIG. 6 shows a target control IC display screen 54 that is available when the control IC button 38 is selected. As described above with respect to display screens directed to line inputs and lamps, a plurality of different types of ballast IC's are available and selectable by moving a slider control at the bottom of the target IC display screen 54. In the example shown in FIG. 6, the IC 2156 non-dimming discrete ballast is selected to be used as the ballast control IC.

Other control IC chips that are preferably available via the present invention include non-dimming discrete ballasts (e.g., IR21571) and a discrete dimming ballast (e.g., IR2159).

FIG. 7 shows a sample select lamp configuration display screen 56 that is preferably available after a user selects the lamp configuration button 40. Choices directed to the lamp configuration are also preferably made by use of a slider control at the bottom of the select lamp configuration display screen 56, and thereafter by selecting one of the individual lamp configurations provided therein. Examples of the types of lamp configurations available by the present invention include single lamps and dual lamps in parallel and in series, with each choice having either voltage-mode heating, current-mode heating and for dual lamp, and parallel, balance transformers. In the example shown in FIG. 7, a dual lamp series/current-mode heating is selected for the electronic ballast circuit.

FIG. 7A shows additional lamp configurations that are available via the present invention. As shown in FIG. 7A, the following lamp configurations are provided: single lamp/voltage-mode heating lamps, dual lamp series/current-mode heating lamps, dual lamp series/voltage-mode heating, dual lamp parallel/current-mode heating, dual lamp parallel/voltage-mode heating and a dual lamp parallel/balance transformer.

FIG. 8 identifies a ballast circuit component conflict display screen 58 that automatically appears to the user in the event that a combination of the line input, the lamp, the control IC and the lamp configuration is not compatible. In the example shown in FIG. 8, the target control IC (in this case, a model 2156 (CFL)) can only operate in a single lamp current mode configuration. In accordance with the principles of the present invention, the configuration is automaticlaly changed by the ballast designing system 10 to reflect a single lamp/current mode heating. Moreover, the target IC 2156 (CFL) design cannot be used with active power factor correction control (PFC). In the example shown in FIG. 8, the ballast designing system 10 is prompting the user to select a different line input. Alternatively, the user could select a different IC that could be used with an active PFC.

As noted above with regard to advanced options, FIGS. 9 and 10 show alternative available options for designing a ballast circuit via the present invention. FIG. 9 shows an example advanced option for inductor display screen 60. As shown therein, a user, using the controls and options, identifies the inductance, peak ignition current, RMS running current, core size and gap size for resonance and PFC inductors (if applicable).

FIG. 10 shows a sample advanced options for line inputs display screen 62 wherein inputs can be provided that include operating points for preheat frequency, ignition frequency, run frequency and ignition current. Further, the amount of time for preheating the lamp is also preferably available. By use of the advanced options, such as those shown in FIGS. 9 and 10, users can exercise greater control over the automatically generated values to produce precise specifications that are required for the electronic ballast circuit.

FIG. 11 shows a sample bill of materials 64 that is preferably generated by the present invention after a user selects the design ballast button 42 from the initial main menu display screen 32. The bill of materials specifies all of the components, including quantity, type, value, rating, tolerance and the corresponding reference numeral in the circuit diagram that is preferably produced by the present invention.

FIG. 12 shows a design circuit diagram 66 corresponding to the illustrative bill of materials shown in FIG. 11 that is preferably generated by the system after a user selects design ballast button 42 from the main menu display screen 32. Included there are referenced numerals that correspond to the bill of materials 64 (FIG. 11). As shown in this sample circuit diagram in FIG. 12, active power factor correction control is provided and specified.

Figure 13A:
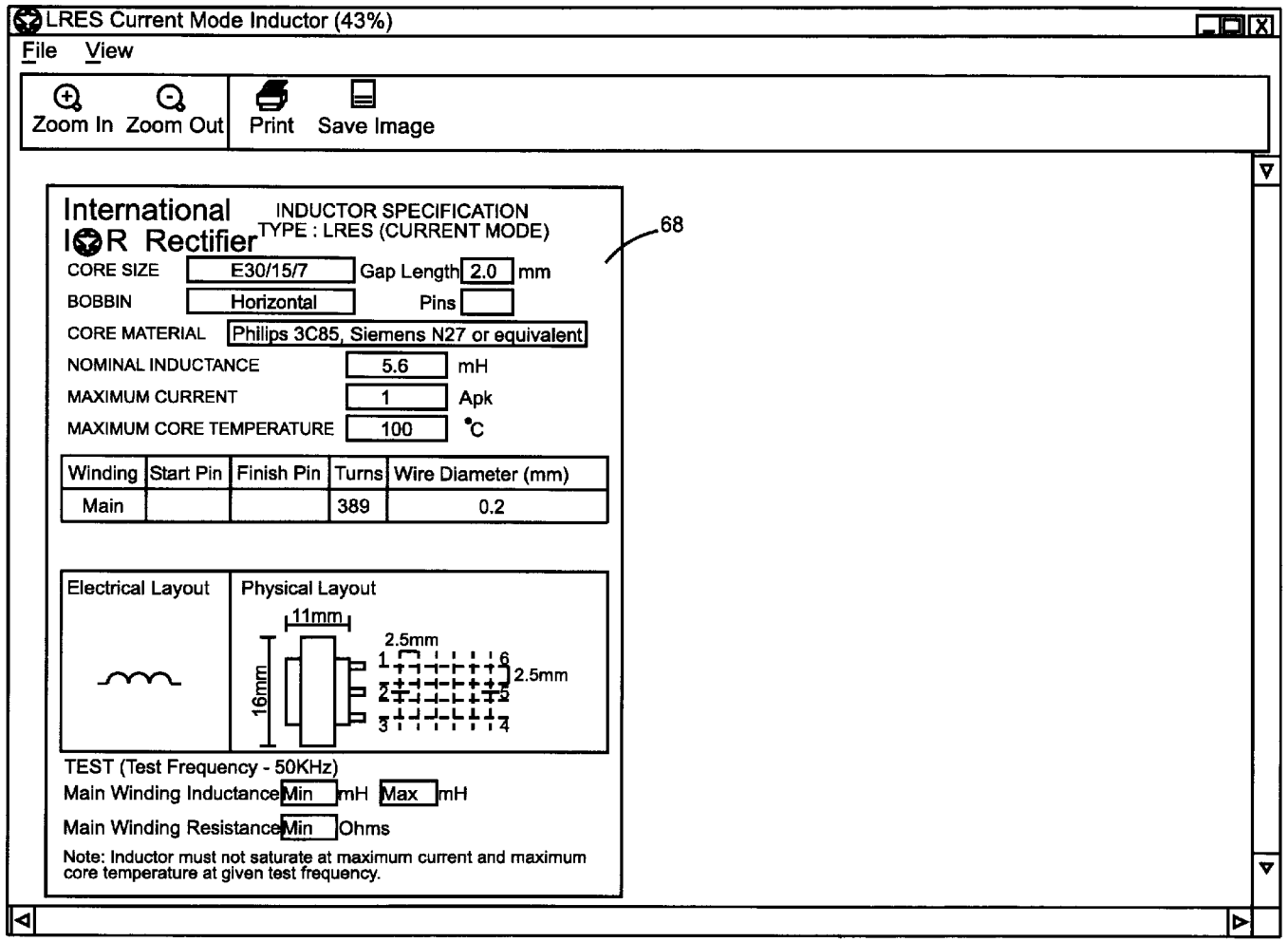
Figure 13B:
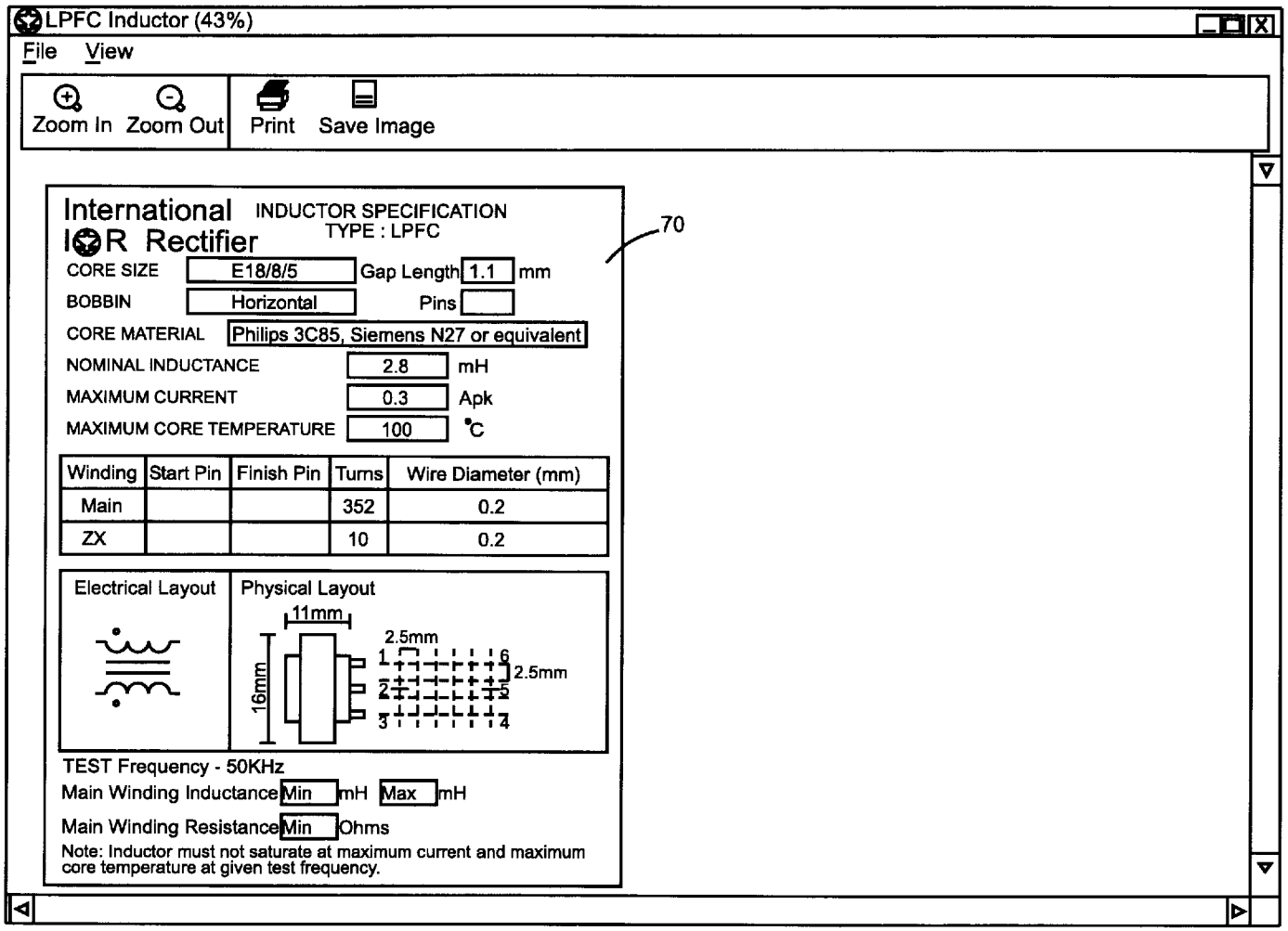

FIGS. 13*a* and 13*b* show inductor specifications 68 and 70, respectively, for output inductors and power factor correction control inductors. Included in the inductor specifications, are the core size, gap length, winding bobbin positioning, number of pins, core material, inductance, maximum current and maximum core temperature. The inductor specifications that are produced by the present invention can be transmitted to a manufacturer who uses the specifications to manufacture an inductor that complies with the electronic ballast circuit.

The following variables are used to calculate proper operating parameters for a non-dimming ballast circuit: preheat current, preheat time, max preheat voltage, ignition voltage, running lamp power, and running lamp voltage. For a 78/36W lamp, the variables are:

| | | |
|---|---|---|
| Preheat Current: | 0.6 | [A] |
| Preheat Time: | 2 | [sec] |
| Max Preheat Voltage: | 600 | [Vpp] |
| Ignition Voltage: | 1500 | [Vpp] |
| Running Lamp Power: | 34 | [W] |
| Running Lamp Voltage: | 141 | [Vpk] |

In a dimmable design, lamp power @ 2%, lamp voltage @ 2%, and min. cathode heating current are also needed. For the above T8/36W lamp, the variables are:

| | | |
|---|---|---|
| Lamp Power @ 2%: | 1 | [W] |
| Lamp Voltage @ 2%: | 215 | [Vpk] |
| Min. Cathode Heating Current: | 0.35 | [A] |

The minimum power is required regardless of the minimum light output that is required.

In a preferred embodiment of the present invention, the ballast designing system 10 uses a simplified model to design the output stage. The simplified model is shown in FIG. 2B. A high performance ballast should provide the lamp with a preheat current in the cathodes for a specified time to bring them to the correct temperature before ignition. During the preheat time, the lamp voltage has to be low enough to ensure that ignition will not occur prematurely. At the end of preheat, a high voltage is required to ignite the lamp and, thereafter, a specific current should be provided to operate the lamp at the correct power. The present invention satisfies these requirements by changing the frequency of the input voltage and properly selecting Vin, L and C. During preheat and ignition, the lamp is not conducting and the circuit is reduced to a series L-C circuit. During running, the lamp is conducting and the circuit is an L in series with a parallel R-C. In accordance with the principles of the present invention, the transfer functions for each mode of operation in an iterative process are used to determine the optimum values for L and C, and further to calculate the operating frequencies. It is preferable to choose the best possible L and C values to optimize the design of the ballast. FIG. 2C shows the transfer function of the RCL circuit with typical operating points.

The present invention uses the following formulae to calculate preheat frequency and voltage:

$$f_{ph} = \frac{I_{ph}}{2\pi C V_{ph}} \text{ [Hz]} \tag{1}$$

$$V_{ph} = -\frac{2V_{in}}{\pi} + \sqrt{\left(\frac{2V_{in}}{\pi}\right)^2 + \frac{L}{C} I_{ph}^2} \tag{2}$$

where, $V_{in}$=Input square-wave peak to peak voltage [Volts]

$V_{ph}$=Lamp preheat peak-to-peak voltage [Volts]

$I_{ph}$=Filament preheat RMS current [Amps]

L=Output stage inductor [Henries]

C=Output stage capacitor [Farads]

These equations (1 and 2) take account only of the fundamental frequency of the square wave produced by the half bridge switches of the switching circuit. Harmonics that exist at higher frequencies have been tested to show only a negligible effect. Experimental results have confirmed that the assumption does not produce inaccurate results.

The above formulae (1 and 2) are used to determine the preheat requirements in a ballast that uses current-mode preheating, which is a relatively simple approach. Some lamps require additional windings from the inductor, or an additional transformer to provide the cathode heating because it is not possible to provide the correct current using values of L and C that are suitable for the running requirements of the lamp without the additional windings or transformer. The ballast designing system 10 uses a different method of approximation if such a configuration is selected. A configuration that relies on auxiliary windings from the inductor to provide the preheat is referred to herein as voltage-mode. However, this term does not imply that such a method would provide a constant voltage at the cathodes.

During ignition, the frequency for a given ignition voltage is calculated using formula (3), since the lamp is still an open circuit.

$$f_{ign} = \frac{1}{2\pi}\sqrt{\frac{1+\frac{\frac{4}{\pi}V_{in}}{V_{ign}}}{LC}} \quad \text{[Hz]} \tag{3}$$

where, $V_{ign}$=Lamp ignition peak to peak voltage [Volts]

The associated ignition current amplitude flowing in the circuit that determines the maximum current ratings for the inductor L and the half bridge MOSFETs, becomes:

$$I_{Cath2\%} = \frac{V_{2\%} f_{2\%} \pi C}{\sqrt{2}} I_{ign} = f_{ign} C V_{ign} 2\pi \tag{4}$$

The present invention uses this current to design an inductor that will not saturate during ignition, thereby preventing the ballast from shutting down at ignition.

Once the lamp has ignited, the R in the model must be included in the equation. The following formula is used for calculating the running frequency:

$$f_{run} = \frac{1}{2\pi}\sqrt{\frac{1}{LC} - \frac{1}{2R^2C^2} + \sqrt{\left[\frac{1}{LC} - \frac{1}{2R^2C^2}\right]^2 - \frac{1-\left(\frac{4V_{in}}{V_{run}}\right)^2}{L^2C^2}}} \tag{5}$$

where R has been assumed to be the linearized lamp resistance determined from the lamp running power and voltage at a single operating point:

$$R = \frac{V_{run}^2}{2P_{run}} \quad \text{[Ohms]} \tag{6}$$

where, $P_{run}$=Lamp running power [Watts]

$V_{run}$=Lamp peak running voltage [Volts]

When calculating the design parameters for a dimming ballast the ballast designing system 10 also utilizes the equation used to determine the running frequency at maximum output, to determine the operating frequency at minimum output. The lamp database contains the measured lamp voltage and power for each lamp type at 2% light output.

$$f_{\%} = \frac{1}{2\pi}\sqrt{\frac{1}{LC} - \frac{32P_{\%}^2}{C^2V_{\%}^4} + \sqrt{\left[\frac{1}{LC} - \frac{32P_{\%}^2}{C^2V_{\%}^4}\right]^2 - \frac{1-\left(\frac{4Vin}{V_{\%}\pi}\right)^2}{L^2C^2}}} \quad \text{[Hz]} \tag{7}$$

Using the above series of equations, the present invention very rapidly calculates and determines whether an acceptable result is obtained. If not, the ballast designing system 10 preferably will iterate the values of L and C until correct results are achieved.

In a preferred embodiment of the present invention, data sheets directed to each part of the desired ballast circuit are available. The values of resistors and capacitors, used for programming the frequencies and other operating parameters for the ballast control IC, are calculated directly using the formulae that have been published in the data sheets for each part. These are directly calculated from the frequencies that the present invention has determined are correct for the selected L and C and the operating parameters of the system.

In accordance with the principles of the present invention, the ballast designing system 10 also calculates the value of the inductor used in a design that employs an active power factor correction (PFC) front end, based on a critical conduction mode boost regulator. Preferably, an industry standard PFC controller is used and specified with the bill of materials. Since critical conduction mode is used, the equation to determine the inductance required and the peak current are as follows.

$$L_{PFC} = \frac{V_{AC}^2 \cdot (V_O - \sqrt{2} \cdot V_{AC})}{2f_{MIN} \cdot P_O \cdot V_O} \tag{9}$$

$$I_{Lpk(MAX)} = 2\sqrt{2} \cdot \frac{P_O}{V_{AC}} \tag{10}$$

where, $V_{AC}$=RMS AC line voltage input $V_O$=Output DC bus voltage $f_{MIN}$=Minimum PFC switching frequency $P_O$=Output Power Also, in accordance with the principles of the present invention, the ballast designing system 10 includes a complete inductor design feature that produces specifications for the ballast output inductor, and the PFC inductor (if applicable). The inductor design feature provides all of the following information from which an inductor can be manufactured that, if wound correctly, will be very close in value to the required value and will be acceptable for building into the ballast prototype circuit:

Core Size

Gap Length

Winding wire diameter

Number of turns

Preferably, a database of core parameters for standard E cores made of standard power grade Ferrite material is stored and/or referred to by the ballast designing system 10. A facility is also preferably included for the user to add additional core specifications to the database allowing any core to be designed into the system. In a preferred embodiment of the present invention, the core database contains core information in ascending order of core size. This is because the design process begins with the smallest size and calculates until it reaches a size where the required inductance and peak current can be realized without the core saturating, i.e. exceeding a specified limit of flux density. A limit of 300 mT has been chosen because it is a very conservative value, and should provide enough headroom so that when the core temperature is high, the inductor will never saturate, even under the worst-case conditions of peak current.

In a preferred embodiment of the present invention, the ballast designing system 10 also calculates the required wire diameter for the lamp running current, and then determines whether the number of turns can be supported on the available bobbin size that will provide the correct inductance for the gap specified. The process begins with a small gap, calculates the number of turns, and then the peak flux density during ignition or worst-case peak current for a PFC inductor. If the flux density is too high, a larger gap will be tried until a size of gap is found that will produce acceptable results. If no acceptable combination can be found, the next size up of core will be tried, starting with a small gap and the process will take place again until the best solution is found. In this way the present invention saves designers a considerable amount of time because the processes described herein carry out the calculations for many combinations until the optimum one is obtained.

FIG. 15 is a flowchart showing the steps involved in outputting specifications for an electronic ballast circuit. In step S10, the inductance and peak current is determined. In step S12, the smallest core size is initially selected given the inductance and peak current determined in step S10. From the smallest core size selected in step S12, the wire size is calculated from the current that was determined in step S10 (step S14). In step S16, the smallest gap size is selected for the current in inductance that is selected from S10. In step S18, the number of winds of wire is determined for the selected gap and core in order to obtain the required inductance. In step S20, the flux density is determined. In step S22, a determination is made whether the flux density has exceeded its limit. If it has not, then the process returns to step S16 wherein the next largest gap is selected. If the flux density has exceeded its limit, then the process moves to step S24 wherein a larger gap is determined to be required. If a larger gap is determined to be required, then the process loops back to step S12, wherein the next largest core size is selected. If a determination has been made in S24 that the larger gap is not needed, then the process moves to step S26 and the specifications are outputted.

The inductor specification that is produced by the present invention is preferably printed out and sent directly to a coil winder. In the advanced mode of the ballast designing system 10 (FIG. 9), the inductor's core size or gap size, or both can be fixed. If the core is fixed, then the ballast designing system 10 calculates the gap size that will produce the best result, and displays the peak flux density, giving a warning if it is above 300 mT. The same happens when the gap size is fixed, the minimum size of core that may be used with this gap will be outputted. In the case of both core and gap being fixed, then the ballast designing system 10 preferably calculates the number of turns, and the peak flux density under worst-case conditions of peak current.

The number of turns required for an inductor with a specific core size and gap is given by:

$$N = \sqrt{\frac{L}{A_L}} \tag{11}$$

The AI value can be calculated from:

$$A_L = \frac{\mu_O \cdot \mu_e \times 10^{-6}}{\sum (l/A)} \text{ (nH)} \tag{12}$$

Where $\mu_e$ varies depending on the size of the gap and be calculated from:

$$\mu_e = \frac{\mu_i}{1 + \left(\frac{G \cdot \mu_i}{l_e}\right)}. \tag{13}$$

The peak flux density is given by:

$$B_{\text{MAX}} = \frac{N \cdot A_L \cdot I_{\text{MAX}}}{A_e} \tag{14}$$

Thus, the ballast designing system 10, as described herein, is unique and useful to assist electronic ballast designers. The system 10 promotes great time savings by precluding designers from repetitive work, thereby reducing the number of errors. Moreover, the amount of development time for a first prototype of a ballast circuit is dramatically reduced by the present invention.

Although the present invention has been described in relation to particular embodiments thereof, many other variations and modifications and other uses will become apparent to those skilled in the art. Therefore, the present invention should not be limited by the specific disclosure herein.

What is claimed is:

1. An electronic ballast design system for designing an electronic lamp ballast circuit, the system comprising:

a line input module, the line input module receiving a line input voltage for the ballast;

a lamp input module, the lamp input module receiving a type of lamp for the ballast;

a control IC module, the control IC module receiving an identification of a ballast integrated circuit chip for the ballast;

a lamp configuration module, the lamp configuration module receiving an identification of a configuration for one or more lamps for the ballast;

a ballast design module responsive to the line input module, lamp input module, control IC module, and lamp configure module, the ballast design module generating a ballast circuit bill of materials, a ballast circuit design schematic, and at least one winding specification for at least one inductor of the ballast circuit calculated from inputs received from each of the line input module, the lamp input module, the control IC module and the lamp configuration module; and further wherein the ballast design module is responsive to a database of core parameters for standard E cores made of standard power grade Ferrite material.

2. The electronic ballast design system of claim 1, wherein the core parameters are sorted in ascending order.

3. An electronic ballast design system for designing an electronic lamp ballast circuit, the system comprising:

a line input module, the line input module receiving a line input voltage for the ballast;

a lamp input module, the lamp input module receiving a type of lamp for the ballast;

a control IC module, the control IC module receiving an identification of a ballast integrated circuit chip for the ballast;

a lamp configuration module, the lamp configuration module receiving an identification of a configuration for one or more lamps for the ballast; and a ballast design module responsive to the line input module, lamp input module, control IC module, and lamp configure module, the ballast design module generating a ballast circuit bill of materials, a ballast circuit design schematic, and at least one winding specification for at least one inductor of the ballast circuit calculated from inputs received from each of the line input module, the lamp input module, the control IC module and the lamp configuration module, wherein the respective winding specification for the at least one inductor includes wire diameter, a gap size, number of turns and core size.

4. The electronic ballast design system of claim 3, wherein the respective winding specification for the at least one inductor precludes the at least one inductor from saturating during ignition.

5. The electronic ballast design system of claim 3, further comprising at least one information source directed to at least one component of the ballast circuit, the at least one information source used to generate the electronic ballast.

6. The electronic ballast design system of claim 3, wherein the control IC module allows a user to select from a plurality of control ICs.

7. The electronic ballast design system of claim 3, wherein the line input module allows a user to select from a plurality of line input circuits.

8. The electronic ballast design system of claim 7, wherein the plurality of line input circuits include a full bridge rectifier, a voltage doubler and active PFC circuits.

9. The electronic ballast design system of claim 3, wherein the ballast design module provides the winding specification for an output inductor of the electronic ballast circuit.

10. The electronic ballast design system of claim 9, wherein the ballast design module provides a winding specification for a PFC inductor when the electronic ballast circuit includes a PFC circuit.

11. The electronic ballast design system of claim 3, wherein the lamp input module allows a user to select from a plurality of lamp types.

12. The electronic ballast design system of claim 3, wherein the lamp configuration module allows a user to select from a plurality of lamp configurations.

13. The electronic ballast design system of claim 12, wherein the plurality of lamp configurations include a single lamp, plural lamps, parallel connected and serial connected lamps.

14. The electronic ballast design system of claim 3, wherein the design module provides a warning if the user selects inputs which are incompatible.

15. The electronic ballast design system claim 3, wherein the ballast design module provides the inductor winding specification operated by a method comprising the steps of:

determining a required inductance and peak current;

selecting a smallest core size from a core data store;

calculating a required wire diameter from the peak current;

determining if the required inductance and peak current can be satisfied using the smallest core size, and if not selecting a next largest core size and repeating the step of determining until the required inductance and peak current can be attained without the core saturating.

16. The electronic ballast design system of claim 15, wherein the design module provides the inductor specification by the further steps of:

determining the number of turns required for obtaining the required inductance and whether the number of turns can be supported on the core for a given gap.

17. The electronic ballast design system of claim 16, wherein the design module provides the inductor specification by the further steps of:

selecting a first gap size;

calculating the number of turns to achieve the required inductance;

calculating a flux density during ignition; and if the flux density is too high, using a larger gap and repeating until the gap size is obtained that will achieve a flux density below the peak flux density.

18. The electronic ballast design system of claim 17, wherein the design module provides the inductor specification by the further steps of obtaining a larger core size from the data store and repeating until a gap size is obtained that will achieve a flux density below the peak flux density.

19. A method for designing an electronic lamp ballast circuit, the method comprising:

receiving a line input voltage for the ballast;

receiving a type of lamp for the ballast;

receiving an identification of a ballast integrated circuit chip for the ballast;

receiving an identification of a configuration for one or more lamps for the ballast;

generating a ballast circuit bill of materials, a ballast circuit design schematic, and at least one winding specification for at least one inductor of the ballast circuit calculated from the received line input voltage, the received lamp type, the received identification of the ballast integrated circuit chip, and the received identification of the lamp configuration; and further wherein the step of generating comprises referencing a database of core parameters for standard E cores made of standard power grade Ferrite material.

20. The method of claim 19, further comprising sorting the core parameters in ascending order.

21. A method for designing an electronic lamp ballast circuit, the method comprising:

receiving a line input voltage for the ballast;

receiving a type of lamp for the ballast;

receiving an identification of a ballast integrated circuit chip for the ballast;

receiving an identification of a configuration for one or more lamps for the ballast; and generating a ballast circuit bill of materials, a ballast circuit design schematic, and at least one winding specification for at least one inductor of the ballast circuit calculated from the received line input voltage, the received lamp type, the received identification of the ballast integrated circuit chip, and the received identification of the lamp configuration, wherein the respective winding specification for the at least one inductor includes wire diameter, a gap size, number of turns and core size.

22. The method of claim 21, wherein the respective winding specification for the at least one inductor precludes the at least one inductor from saturating during ignition.

23. The method of claim 21, further comprising at least one information source directed to at least one component of the ballast circuit, the at least one information source used to generate the electronic ballast.

24. The method of claim 21, further comprising receiving a selection from a plurality of control ICs.

25. The method of claim 21, further comprising receiving a selection from a plurality of line input circuits.

26. The method of claim 25, wherein the plurality of line input circuits include a full bridge rectifier, a voltage doubler and active PFC circuits.

27. The method of claim 21, further comprising providing a winding specification for an output inductor of the electronic ballast circuit.

28. The method of claim 27, further comprising providing a winding specification for a PFC inductor when the electronic ballast circuit includes a PFC circuit.

29. The method of claim 21, further comprising receiving a selection from a plurality of lamp types.

30. The method of claim 21, further comprising receiving a selection from a plurality of lamp configurations.

31. The method of claim 30, wherein the plurality of lamp configurations include a single lamp, plural lamps, parallel connected and serial connected lamps.

32. The method of claim 21, further comprising providing a warning when a combination of at least two of the received line input voltage, the received lamp type, the received ballast integrated circuit chip, and the received configuration for one or more lamps is incompatible.

33. A method for designing an electronic lamp ballast circuit, the method comprising:

receiving a line input voltage for the ballast;

receiving a type of lamp for the ballast;

receiving an identification of a ballast integrated circuit chip for the ballast;

receiving an identification of a configuration for one or more lamps for the ballast;

generating a ballast circuit bill of materials, a ballast circuit design schematic, and at least one winding specification for at least one inductor of the ballast circuit calculated from the received line input voltage, the received lamp type the received identification of the ballast integrated circuit chip, and the received identification of the lamp configuration, further wherein the step of generating comprises referencing a database of core parameters for standard E cores made of standard power grade Ferrite material; and providing the inductor winding specification by the steps of:

determining a required inductance and peak current;

selecting a smallest core size from a core data store;

calculating a required wire diameter from the peak current;

determining if the required inductance and peak current can be satisfied using the smallest core size, and if not selecting a next largest core size and repeating the step of determining until the required inductance and peak current can be attained without the core saturating.

34. The method of claim 33, further comprising providing the inductor specification by the further steps of:

determining the number of turns required for obtaining the required inductance and whether the number of turns can be supported on the core for a given gap.

35. The method of claim 34, further comprising providing the inductor specification by the further steps of:

selecting a first gap size;

calculating the number of turns to achieve the required inductance;

calculating a flux density during ignition; and if the flux density is too high, using a larger gap and repeating until a gap size is obtained that will achieve a flux density below the peak flux density.

36. The method of claim 35, further comprising providing the inductor specification by the further steps of obtaining a larger core size from the data store and repeating until the gap size is obtained that will achieve the flux density below the peak flux density.

* * * * *